US007275799B2

(12) United States Patent
Hayashi et al.

(10) Patent No.: US 7,275,799 B2
(45) Date of Patent: Oct. 2, 2007

(54) IMAGE FORMING APPARATUS

(75) Inventors: Shigeyuki Hayashi, Nagoya (JP); Masatoshi Kokubo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 284 days.

(21) Appl. No.: 10/885,696

(22) Filed: Jul. 8, 2004

(65) Prior Publication Data

US 2004/0246290 A1 Dec. 9, 2004

Related U.S. Application Data

(63) Continuation-in-part of application No. PCT/JP03/00228, filed on Jan. 14, 2003.

(30) Foreign Application Priority Data

Jan. 11, 2002 (JP) ..... 2002-004733

(51) Int. Cl.
*B41J 2/393* (2006.01)
*B41J 2/38* (2006.01)

(52) U.S. Cl. ..... 347/19; 347/16

(58) Field of Classification Search ..... 347/2, 347/4, 9, 19, 101, 104–105
See application file for complete search history.

(56) References Cited

U.S. PATENT DOCUMENTS 4,794,384 A 12/1988 Jackson
5,564,848 A * 10/1996 Quintana ..... 400/708
6,220,686 B1 4/2001 Lüdi et al.
6,325,505 B1 * 12/2001 Walker ..... 347/105
6,517,180 B2 * 2/2003 Tullis et al. ..... 347/19

FOREIGN PATENT DOCUMENTS

JP A 02-255360 10/1990
JP B2 06-038224 5/1994
JP A 09-001880 1/1997
JP A 11-116100 4/1999

* cited by examiner

*Primary Examiner*—Hai Pham
(74) *Attorney, Agent, or Firm*—Oliff & Berridge, PLC

(57) ABSTRACT

There is provided an image forming apparatus which can control reciprocation of a carriage and paper feed in a highly accurate manner and form an image of high quality even when paper skews or paper of a different type from that of the paper set is supplied. An ink jet printer (1) provided with a motion sensor (70) in a carriage (31) determines the type of paper (P) by using a paper position signal output by the motion sensor (70) and changes printing conditions in accordance with the type of paper. Also, the ink jet printer (1) calculates a moving amount of the carriage (31), a feed amount and a deviation amount of the paper (P), and controls the reciprocation of the carriage (31) and the feeding of the paper (P) based on calculated values.

15 Claims, 19 Drawing Sheets

FIG. 7

| | CR SPEED | HEAD DRIVE WAVEFORM |
|---|---|---|
| SECTION A | ACCELERATING | WAVEFORM 1 |
| SECTION B | ACCELERATING | WAVEFORM 2 |
| SECTION C | CONSTANT | WAVEFORM 3 |
| SECTION D | DECELERATING | WAVEFORM 2 |
| SECTION E | DECELERATING | WAVEFORM 1 |

IMAGE FORMING APPARATUS

This is a continuation-in-part of PCT application PCT/JP03/00228 filed Jan. 14, 2003, titled "Image Forming Apparatus".

TECHNICAL FIELD

The present invention relates to an image forming apparatus capable of controlling reciprocation of a carriage and paper feed in a highly accurate manner.

BACKGROUND ART

An image forming apparatus such as a printer is conventionally provided with a carriage which is reciprocable in a direction perpendicular to a paper feed direction (a main scanning direction) by a driving force transmitted from a stepping motor or a DC motor with an encoder through a train of gears.

During printing, the carriage selectively ejects ink from ink jet nozzles formed at the lower face of the carriage on the basis of dot pattern data while reciprocating.

Although the control of the reciprocation of the carriage is performed by controlling the rotation amount of the stepping motor or the DC motor with an encoder as the driving source, the control cannot be achieved in a highly accurate manner because of rotational pitch errors due to the structure of the motor, accuracy errors of gears caused during manufacture thereof or the like.

Regarding paper feed, although the control of the feed amount of paper is performed also by controlling the rotation amount of the stepping motor or the DC motor with an encoder as the driving source, the paper feed cannot be achieved in a highly accurate manner because of rotational pitch errors due to the structure of the motor, accuracy errors of gears caused during manufacture thereof, errors in outer diameters of feed rollers, errors in feed amounts that are dependent on the types of paper used, or the like.

There are further problems that when the actual paper feed direction is deviated with respect to the feed path of the printer, the printing area of paper is shifted from the center, and that when paper of a different type from that of the paper set at the printer is supplied, requirements for printing become inappropriate and thus printing cannot be performed appropriately.

DISCLOSURE OF INVENTION

The present invention, which has been made in view of these problems, has an object to provide an image forming apparatus capable of controlling reciprocation of a carriage and paper feed in a highly accurate manner and of forming images of high quality even when paper skews or paper of a different type from that of paper set at the printer is supplied.

(1) The invention of claim 1 provides an image forming apparatus having a recording device provided to be reciprocable in a width direction of paper that performs recording on the paper. The image forming apparatus comprises: a paper position signal generating device that irradiates the paper with a light with coherence and receives a reflected light of the light with coherence to generate a paper position signal with respect to a position of the paper, wherein the paper position signal generating device is provided so as to move in synchronization with the recording device in the width direction.

According to the image forming apparatus of the present invention, it is possible to detect the position of the paper by using the paper position signal generated by the paper position signal generating device. Additionally, it is possible to detect the moving amount of the paper (e.g. the paper feed amount in the feed direction, the deviation amount of the paper in a direction perpendicular to the feed direction), for example, by chronologically comparing the paper position signals during the feeding of the paper.

Accordingly, the image forming apparatus of the present invention can, for example, detect the moving amount (feed amount) of the paper in the feed direction and accurately control the feed of the paper by using the detected feed amount. Thus, the image forming apparatus of the present invention is capable of forming an image of high quality.

In addition, the image forming apparatus of the present invention, for example, detects the deviation amount of the paper and changes a printing area on the paper in accordance with the deviation amount, thereby preventing deviation of the printing area on the paper.

Especially in the image forming apparatus of the present invention, in which the paper position signal generating device is configured so as to move in synchronization with the recording device in the width direction, it is possible to detect the moving amount of the recording device in the width direction with respect to the paper by chronologically comparing the paper position signals generated by the paper position signal generating device during the movement of the recording device in the width direction. Thus, the image forming apparatus of the present invention is capable of forming an image of high quality.

Consequently, the image forming apparatus of the present invention can accurately control the movement of the recording device, for example, by using the moving amount of the recording device detected as above.

The above-mentioned width direction means, for example, a direction perpendicular to the paper feed direction.

(2) The invention of claim 2 provides the image forming apparatus as set forth in claim 1, wherein the paper position signal generating device is mounted to a carriage that holds the recording device.

The present invention illustrates how to mount the paper position signal generating device.

According to the present invention, since the paper position signal generating device is mounted to the carriage holding the recording device (e.g. an ink jet head), the paper position signal generating device can move in synchronization with the recording device in the main scanning direction of the carriage (the width direction).

(3) The invention of claim 3 provides the image forming apparatus as set forth in claim 1 or 2, which comprises a recording device moving amount detection device that detects a recording device moving amount that is a moving amount of the recording device in the width direction by using the paper position signal.

The image forming apparatus of the present invention, which is provided with the recording device moving amount detection device that detects the moving amount of the recording device in the width direction (the recording device moving amount), for example, can accurately control recording on the paper by the recording device by using the detected moving amount of the recording device.

As an example, the recording device moving amount detection device detects the moving amount of the recording device in the width direction, by chronologically comparing paper position signals generated by the paper position signal generating device during the movement of the recording device.

(4) The invention of claim 4 provides the image forming apparatus as set forth in claim 3, wherein the recording on the paper by the recording device in the width direction is controlled by using the moving amount of the recording device.

According to the image forming apparatus of the present invention, it is possible to control the recording on the paper by the recording device by using the moving amount of the recording device detected by the moving amount of recording device moving amount detection device, and thereby to form an image of high quality.

Control of recording on the paper by the recording device may be performed, for example, by determining the timing of recording on the paper by the recording device based on the moving amount of the recording device.

(5) The invention of claim 5 provides the image forming apparatus as set forth in claim 3 or 4, wherein the recording device moving amount detection device detects the moving amount of the recording device with respect to the paper by chronologically comparing speckle patterns generated by the light being reflected from the paper.

The present invention illustrates how to detect the moving amount by the recording device moving amount detection device.

According to the image forming apparatus of the present invention, since the moving amount of the recording device with respect to the paper is detected by chronologically comparing speckle patterns generated in the reflected light from the paper, the moving amount of the recording device can be detected accurately. Thus, the image forming apparatus of the present invention is capable of forming an image of high quality.

A specific method of detecting the moving amount of the recording device may include, for example, chronologically comparing the speckle patterns to determine the moving amount thereof, and then detecting the moving amount of the recording device based on the moving amount of the speckle patterns.

The speckle patterns mean interference patterns generated in the reflected light when a light with coherence is reflected on the surface of an object. The speckle patterns are influenced by the surface shape of the object at the point where the light is reflected. When the recording device is moved with respect to the paper, the point where the light is reflected is shifted, with the result that the speckle patterns in the reflected light are moved. In other words, the moving amount of the speckle patterns corresponds to the moving amount of the recording device with respect to the paper.

(6) The invention of claim 6 provides the image forming apparatus as set forth in any one of claims 1-5, which comprises a paper feed device that feeds the paper and a paper feed amount detection device that detects the paper feed amount by using the paper position signal.

The image forming apparatus of the present invention, which is provided with the paper feed amount detection device that detects the paper feed amount, can accurately control, for example, the paper feed by using the paper feed amount detection device. Thus, the image forming apparatus of the present invention is capable of forming an image of high quality.

As an example, the paper feed amount detection device detects the paper feed amount by, for example, chronologically comparing paper position signals generated by the paper position signal generating device during the paper feed.

(7) The invention of claim 7 provides the image forming apparatus as set forth in claim 6, wherein the feed device is controlled by using the paper feed amount detection device.

According to the image forming apparatus of the present invention, it is possible to control the paper feed device by using the paper feed amount detected by the paper feed amount detection device, and thereby to achieve a highly accurate paper feed and to form an image of high quality.

A specific method of controlling the paper feed device by using the paper feed amount detection device may include, for example, determining timing of feed and interruption of paper feed (e.g. interruption of feeding for recording by the recording device) based on the paper feed amount detected by the paper feed amount detection device.

(8) The invention of claim 8 provides the image forming apparatus as set forth in any one of claims 1-7, wherein the paper feed amount detection device calculates the paper feed amount by chronologically comparing speckle patterns generated by the light being reflected from the paper.

According to the image forming apparatus of the present invention, the paper feed amount is detected by chronologically comparing speckle patterns generated in the reflected light from the paper, and therefore the paper feed amount can be detected accurately. Thus, the image forming apparatus of the present invention is capable of forming an image of high quality.

A specific method of detecting the paper feed amount may include, for example, determining the moving amount of the speckle patterns generated in the reflected light during the paper feed, and then detecting the paper feed amount based on the moving amount of the speckle patterns.

The speckle patterns are influenced by the surface shape of the paper at the point where the light is reflected. When the paper is fed, the point where the light is reflected is shifted, with the result that the speckle patterns in the reflected light are moved. In other words, the moving amount of the speckle patterns corresponds to the paper feed amount.

(9) The invention of claim 9 provides the image forming apparatus as set forth in any one of claims 1-8, which further comprises a deviation detection device that detects deviation when the paper is fed by using the paper position signal.

The image forming apparatus of the present invention, which is provided with the deviation detection device that detects deviation when the paper is fed, can control the movement of the recording device in the width direction, for example, based on the detected deviation amount. Accordingly, the image forming apparatus of the present invention prevents deviation of the printing area on the paper or printing on a place other than the paper resulting in stains on the image forming apparatus.

As an example, the deviation amount detection device detects the deviation of the paper by, for example, chronologically comparing paper position signals generated by the paper position signal generating device during the feeding of the paper in the feed direction.

The deviation means that, for example, the paper is moved in a direction different from the original direction during the paper feed.

(10) The invention of claim 10 provides the image forming apparatus as set forth in claim 9, wherein the movement of the recording device is controlled based on the deviation amount detected by the deviation detection device.

The image forming apparatus of the present invention, in which the movement of the recording device is controlled based on the deviation amount detected by the deviation detection device, for example, prevents deviation of the printing area on the paper or printing on a place other than the paper resulting in stains on the image forming apparatus.

(11) The invention of claim 11 provides the image forming apparatus as set forth in claim 10, wherein the movement of the recording device is controlled such that a position at which recording on the paper is performed is a predetermined position.

This invention illustrates control of the movement of the recording device based on the deviation amount detected by the deviation detection device.

According to the present invention, for example, when a deviation of the paper in a specific direction during paper feed is detected by the deviation detection device, the moving range of the recording device (the position of the recording device when forming an image on the paper) is shifted to the direction of the deviation by an amount corresponding to the deviation amount.

As a result, the position of the image on the paper is prevented from being shifted despite the deviation of the paper.

Also, it is prevented from forming an image by the recording device (for example, ejecting ink) to the outside of the paper and thereby prevented from staining the image forming apparatus.

(12) The invention of claim 12 provides the image forming apparatus as set forth in any one of claims 1-11, which further comprises a paper condition identification device that identifies conditions of the paper by using the paper position signal.

According to the image forming apparatus of the present invention, in which conditions of the paper (e.g. the type of the paper) are identified by the paper condition identification device, it may be possible to change the recording conditions of the recording device (for example, the amount of ink droplets to be ejected in the case where the recording device is an ink jet head), for example, in accordance with the identified conditions of the paper. Thus, the image forming apparatus of the present invention is capable of forming an image under the recording conditions suitable for the paper.

(13) The invention of claim 13 provides the image forming apparatus as set forth in claim 12, wherein the paper condition identification device identifies the type of the paper based on the speckle patterns generated by the light being reflected from the paper.

The present invention illustrates a paper condition identification device.

The speckle patterns generated by the reflected light from the paper are influenced by the surface shape of the paper, and therefore vary depending on the conditions of the paper (e.g. the type of the paper).

Then, according to the present invention, the conditions of the paper are identified based on the speckle patterns.

Therefore, according to the image forming apparatus of the present invention, it may be possible, for example, to change the recording conditions of the recording device in accordance with the identified conditions of the paper. Thus, the image forming apparatus of the present invention is capable of forming an image under the recording conditions suitable for the paper.

(14) The invention of claim 14 provides the image forming apparatus as set forth in claim. 12 or 13, wherein the recording device changes recording conditions depending on conditions of the paper identified by the paper condition identification device.

According to the image forming apparatus of the present invention, it is possible to change the recording conditions in accordance with the identified conditions of the paper by the paper condition identification device, and thereby to form an image of high quality.

The recording conditions are, for example, the amount of ink droplets, i.e. the number of times of ejection of ink and the size of droplets in the case where the recording device is a device to eject ink (for example, an ink jet head).

(15) The invention of claim 15 provides the image forming apparatus as set forth in any one of claims 1-14, wherein the paper feed is prohibited while the recording device is moved in the width direction, and wherein the movement of the recording device in the width direction is prohibited while the paper is fed.

According to the image forming apparatus of the present invention, in which the paper feed is prohibited while the recording device is moved in the width direction, changes in the paper position signal during the movement of the recording device are not affected by the paper feed.

With this arrangement, the image forming apparatus of the present invention is capable of, for example, accurately detecting the moving amount of the recording device.

According to the image forming apparatus of the present invention, in which the movement of the recording device is prohibited while the paper is fed, changes in the paper position signal during the period of time are not affected by the movement of the recording device.

With this arrangement, the image forming apparatus of the present invention is capable of accurately detecting, for example, the feed amount and the deviation amount of the paper.

(16) The invention of claim 14 provides the image forming apparatus as set forth in any one of claims 1-15, wherein receipt of the light is performed by using a photoreceptor including a plurality of two-dimensionally arranged pixels.

Since the image forming apparatus of the present invention includes the photoreceptor provided with a plurality of two-dimensionally arranged pixels, a paper position signal can be generated as a two-dimensional image signal, for example, based on the received reflected light.

Accordingly, it is possible, for example, to accurately calculate the moving amount of the recording device, the paper feed amount and the deviation amount of the paper, or to accurately identify the conditions of the paper by using the paper position signal. Thus, the image forming apparatus of the present invention is capable of forming an image of high quality.

(17) The invention of claim 15 provides the image forming apparatus as set forth in any one of claims 1-14, wherein a position at which the light is reflected by the paper is upstream with respect to the paper feed direction from a position at which the recording device performs recording.

In the image forming apparatus of the present invention, the position where the light is reflected on the paper is upstream from the recording device, and therefore recording by the recording device has not been performed at the position.

Accordingly, the reflected light is not changed due to the recording on the paper by the recording device (e.g. application of ink), or the paper position signal generated based on the reflected light is not changed due the surface condition of the paper.

As a result, the image forming apparatus is capable of, for example, accurately calculating the moving amount of the recording device, the paper feed amount and the deviation amount of the paper, or accurately identifying the conditions of the paper by using the paper position signal.

BRIEF DESCRIPTION OF DRAWINGS

FIG. 7 is an explanatory view showing the operation of the carriage 31 in the ink jet printer 1 of Embodiment 1;

BEST MODE FOR CARRYING OUT THE INVENTION

Figure 1:
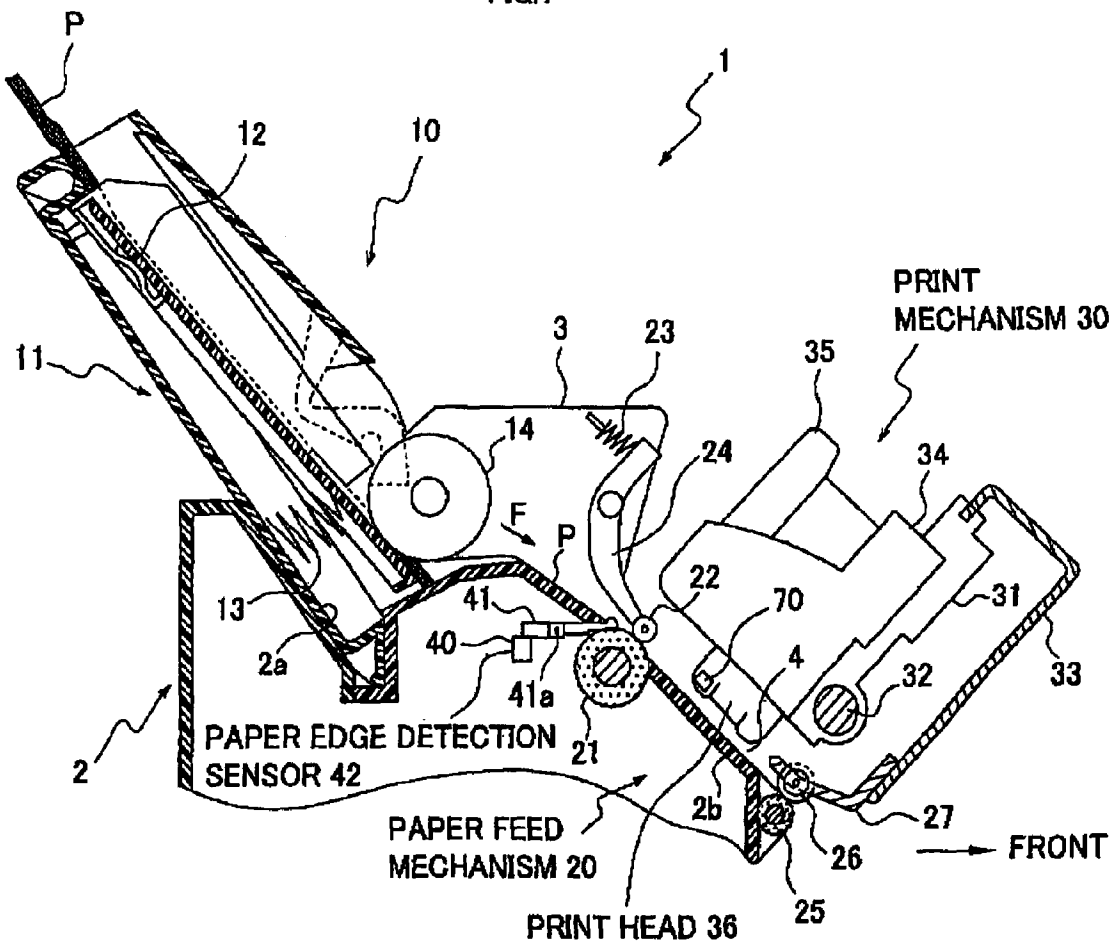
FIG. 1 is an explanatory view showing the overall structure of an ink jet printer 1 of Embodiment 1.

An example (embodiment) of the image forming apparatus of the present invention will now be described hereinafter. It should be noted that the image forming apparatus is exemplarily illustrated as an ink jet printer in this embodiment.

Embodiment a) The overall structure of an ink jet printer 1 will now be described using FIG. 1.

The ink jet printer 1 includes a paper supply mechanism 10 capable of accommodating a plurality of sheets of paper P and of supplying the plurality of sheets of paper one by one, a paper feed mechanism 20 for feeding the paper P that has been supplied by the paper supply mechanism 10 to a paper eject table (not shown) through a paper feed path 4, a print mechanism 30 for printing (forming an image) by ejecting ink onto the paper P during feeding, a drive mechanism (not shown) for transmitting driving force to rollers provided in the paper supply mechanism 10 and the paper feed mechanism 20, a control mechanism 50 (not shown) for controlling actions of each of the above-listed components, and a main body frame 2 for supporting each of the above-listed components.

b) The structure of the paper supply mechanism 10 will now be described using FIG. 1.

The paper supply mechanism 10 includes a paper feed cassette 11 which is attached in a freely attachable/detachable manner to a cassette mounting concave 2*a* formed at an upper end of a rear end portion of the main body frame 2.

The paper feed cassette 11 includes, on the upper side thereof (upper side in FIG. 1), a paper table 12 onto which a plurality of sheets of paper P are stacked. A rear end portion (left-hand side in FIG. 1) of the paper table 12 is pivotally supported at a main body of the paper feed cassette 11 in a freely swinging manner while a front end portion (right-hand side in FIG. 1) thereof is biased upwardly by a compression coil spring 18.

Further, the paper supply mechanism 10 includes a paper feed roller 14 extending in the left and right directions (in the depth direction in FIG. 1) on an upper side of the front end portion of the paper table 12. Both left and right ends of the paper feed roller 14 are pivotally supported, each in a freely rotating manner, by a pair of right and left side wall plates 3 coupled to the main body frame 2, and the paper feed roller 14 is rotated by the driving force that is transmitted from a feed motor 62 (not shown) through the drive mechanism (not shown).

The plurality of sheets of paper P stacked on the paper table 12 of the paper feed cassette 11 are pressed against the paper feed roller 14 by the compression coil spring 13 through the paper table 12. Accordingly, when the paper feed roller 14 is rotated by the drive mechanism in a counter-clockwise direction, the uppermost sheet of paper P that contacts the paper feed roller 14 is fed in a paper feed direction F (right-hand side direction in FIG. 1) directed to the print mechanism 30.

c) The structure of the paper feed mechanism 20 will now be described using FIGS. 1 to 3.

The paper feed mechanism 20 is provided with a paper feed path 4 for feeding paper P. The paper feed path 4 includes a part of the main body frame 2 that extends from the cassette mounting concave 2*a* to a frontward extending paper guide portion 2*b*.

The paper feed mechanism 20 is further provided with a rubber-made first feed roller 21 pivotally supported in a rotating manner in the paper feed path 4 upstream (left-hand side in FIG. 1) from a later described print head 36 of the print mechanism 30. The first feed roller 21 is driven in a clockwise direction (clockwise direction in FIG. 1) by the driving force transmitted from the drive mechanism. A follower roller 22 abuts the first feed roller 21 from above. The follower roller 22 is pivotally attached to a lower end of the swinging arm 24, and the swinging arm 24, in turn, is pivotally attached to the side wall plates 3 at its upper end portion while being pressed and biased in a direction of pressing the follower roller 22 against the first feed roller 21 by means of a compression coil spring 23.

The paper feed mechanism 20 is further provided with a rubber-made second feed roller 25 pivotally supported by the main body frame 2 in a rotating manner in the paper feed path 4 downstream from the print head 36. The second feed roller 25 is driven in the clockwise direction (clockwise direction in FIG. 1) by the driving force transmitted from the drive mechanism. A plurality of spur rollers 26 abut the second feed roller 25 from above. The spur rollers 26, each of which is a gear-like roller with a plurality of radial protrusions, are pivotally supported in a rotating manner by a mounting plate 27 that is fixedly attached to a later described supporting plate 33 at specified intervals in the printing width direction (depth direction in FIG. 1).

With the above-described arrangement, the paper P that has been supplied from the paper supply mechanism 10 is fed in the paper feed direction F in accordance with the rotation of the first feed roller 21 and the second feed roller 25.

The paper feed mechanism 20 is further provided with a paper edge detection sensor 42 for detecting presence or absence of paper P slightly upstream from the print head 36.

As shown in FIG. 1, the paper edge detection sensor 42 includes a rotating portion 41 provided so as to be rotatable about axis 41*a* and biased in a counter-clockwise direction, and a detecting portion 40 that is switched off when the rotating portion 41 rotates in a counter-clockwise direction, while being switched on when the rotating portion 41 rotates in a clockwise direction.

The operation of the paper edge detection sensor 42 at the time when the paper P passes therethrough will be described below. When paper P is not present in the vicinity of the print head 36, the rotating portion 41 is rotated in a counter-clockwise direction by the biasing force with its tip end (right end in FIG. 1) projecting upward above the paper feed path 4. In the case, the detecting portion 40 is in an off state.

When the paper P is fed from the upstream and its leading end rotates the rotating portion 41 in the clockwise direction, the detecting portion 40 is in an on state.

When the paper P further proceeds so that its trailing end passes the rotating portion 41, the rotating portion 41 is rotated again in the counter-clockwise direction by the biasing force and the detecting portion 40 is switched off.

In other words, the paper edge detection sensor 42 is switched on in the presence of paper P, while it is switched off in the absence of paper P, so that presence or absence of paper P may be detected.

d) The structure of the print mechanism 30 will now be described using FIGS. 1 to 5.

The print mechanism 30 is provided with a guide rod 32 supported by not-shown side walls and extending in the left and right directions (depth direction in FIG. 1), a supporting plate 33 provided in front of the main body frame 2 (right-hand side in FIG. 1) so as to project upward, and a carriage 31 supported by the guide rod 32 and an upper end portion of the supporting plate 33 so as to be movable in the left and right directions.

A cartridge holder 34 is fixed to the carriage 31, and an ink cartridge 35 containing therein ink to be supplied for printing is attached to the cartridge holder 34 in an attachable/detachable manner.

Print heads 36*a-d* (see FIG. 5) corresponding, respectively, to four colors of Y, C, M. K, are mounted to the carriage 31 so as to face the paper feed path 4. A plurality of ink jet nozzles (not shown) which eject ink supplied from the ink cartridge 35 are formed in the print head 36. The ink jet nozzles may be arranged such that, for instance, total 64 nozzles are arranged in a double row, with 32 nozzles in each row.

The carriage 31 can be reciprocated in a perpendicular direction to the feed direction F of the paper (main scanning direction) by the driving force transmitted from the CR motor 63 through a not-shown carriage drive mechanism. During printing, the carriage 31 (ink jet nozzles) selectively eject ink through, for instance, the 64 ink jet nozzles on the basis of dot pattern data to be printed while performing reciprocating movement.

Figure 2:
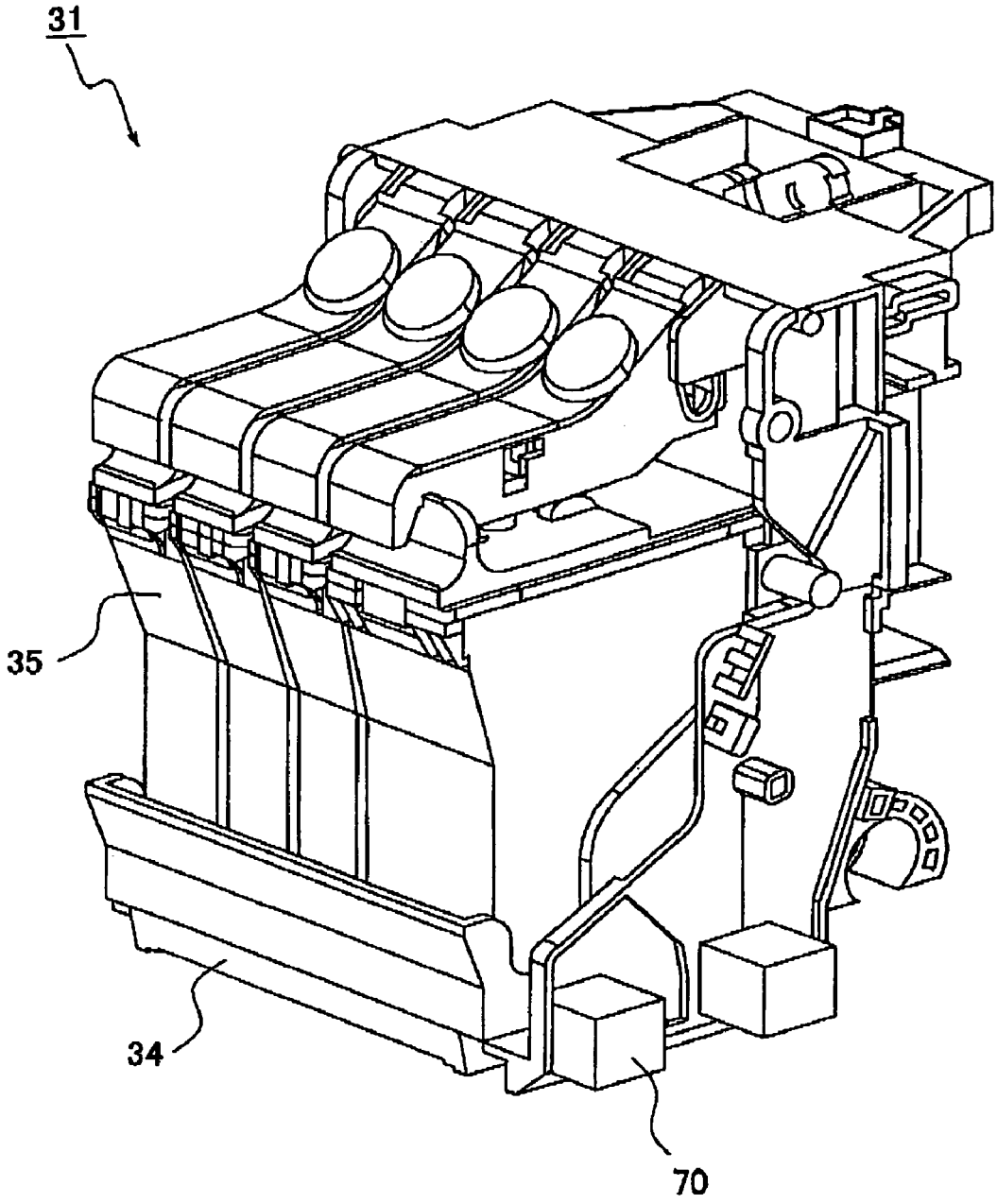
FIG. 2 is an explanatory view showing the structure of a peripheral portion of a paper feed mechanism 20 in the ink jet printer 1 of Embodiment 1.

Also, a motion sensor 70 is provided at a lower end portion of the side surface of the carriage 31 as shown in FIG. 2. Accordingly, in accordance with (in synchronization with) the movement of the carriage 31 in the main scanning direction, the motion sensor 70 is moved in the same direction.

Figure 3:
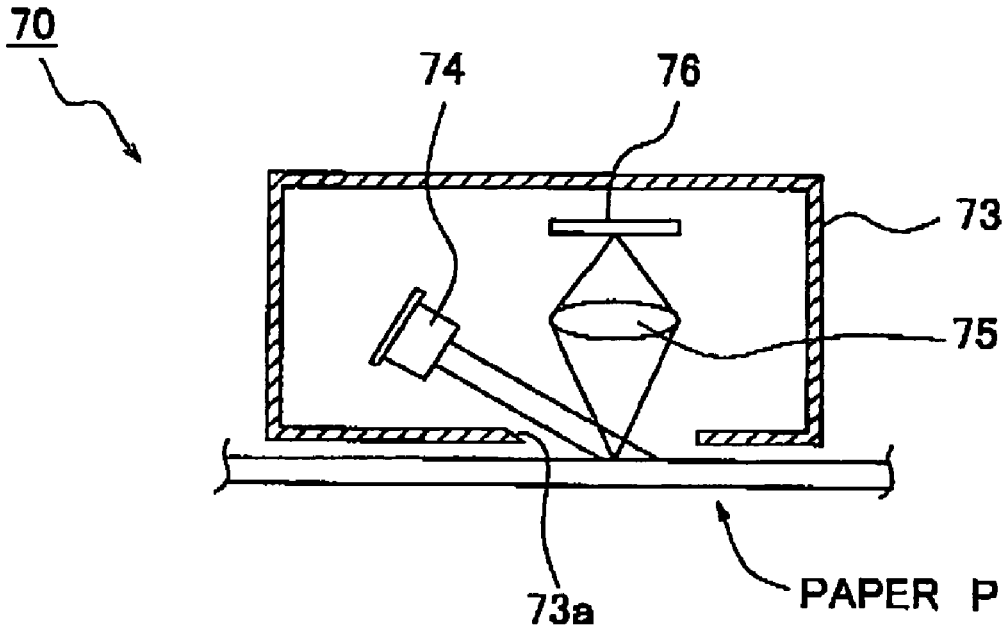
FIG. 3 is an explanatory view showing the structure of a motion sensor 70 in the ink jet printer 1 of Embodiment 1.

As shown in FIG. 3, the motion sensor 70 is provided with a semiconductor laser 74 for irradiating laser light towards the paper, a lens 75 for receiving the reflected light of the laser light, a two-dimensional semiconductor image sensor 76 and a housing 73 for containing the above members.

The semiconductor laser 74 irradiates laser light onto the paper P through an aperture portion 73*a* provided in the housing 73, and then the reflected light is introduced to the two-dimensional semiconductor image sensor 76 through the aperture portion 73*a* and the lens 75. The reflected light includes an interference pattern of spots referred to as speckles (a speckle pattern), which pattern corresponds to the surface shape of the paper P at the point where the laser light has been reflected.

The two-dimensional semiconductor image sensor 76 is provided with a light-receiving portion in which, for example, 400 by 400 pixels of approximately 5 μm size are arranged, and performs photoelectric conversion of the reflected light from the paper P to generate an image signal 70*a*. The image signal 70*a* is transmitted to a motion sensor processing circuit 77 (FIG. 5) in a control circuit 50.

The image signal 70*a* output from the motion sensor 70, which is generated based on the reflected light including the speckle pattern as described above, also includes a speckle pattern corresponding to the surface shape of the paper P at the point where the laser light is reflected. Accordingly, when the paper P is fed or when the carriage 31 is shifted with respect to the paper P, the point where the laser light is reflected is shifted, and thereby the speckle pattern in the image signal 70*a* is also shifted.

That is, the shift of the speckle pattern in the image signal 70*a* corresponds to the movement of the paper P or the shift of the carriage 31.

The image signal 70*a* is used during printing for determining the type of the paper P, detecting the leading end and the trailing end of the paper P, controlling the paper feed and controlling the reciprocation of the carriage 31, which will be described later in detail.

e) The structure of the control mechanism 50 (controller) will now be described using FIGS. 4 and 5.

Figure 4:
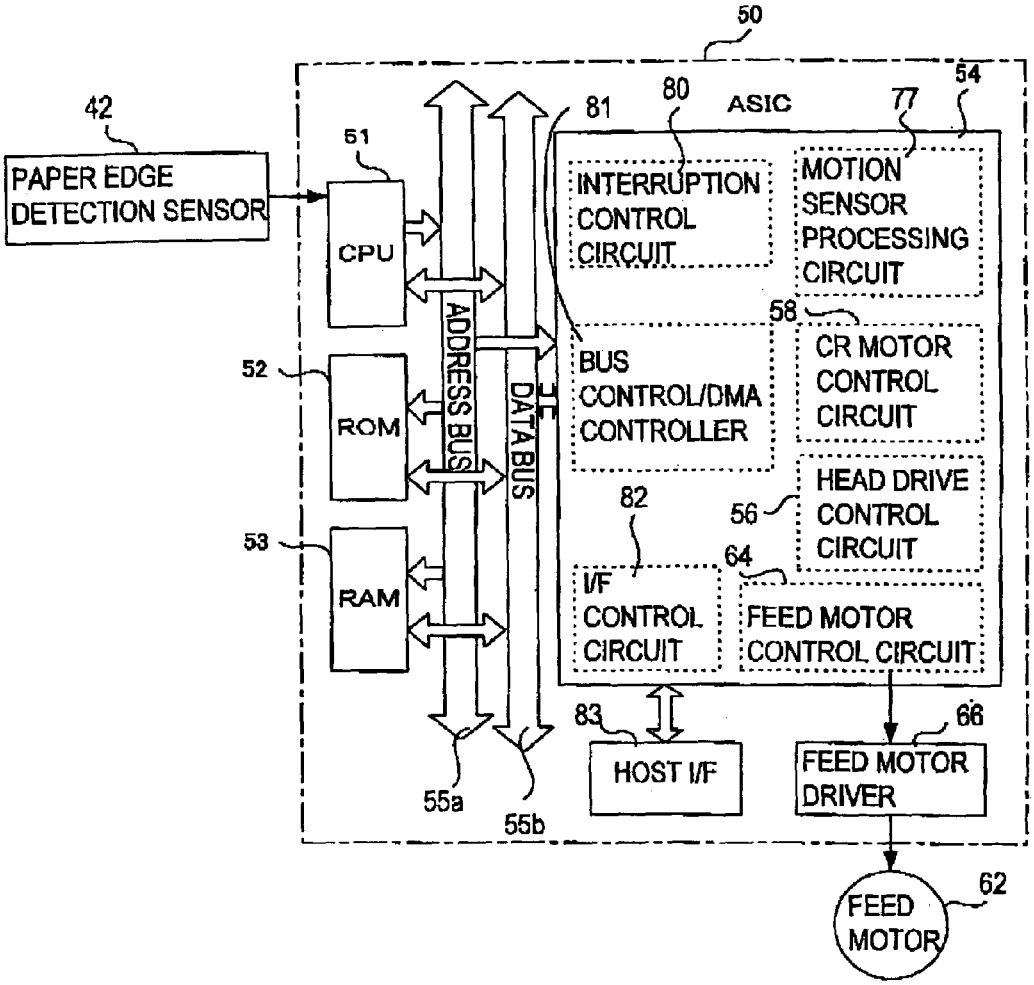
FIG. 4 is an explanatory view showing the structure of a controller 50 in the ink jet printer 1 of Embodiment 1.
Figure 5:
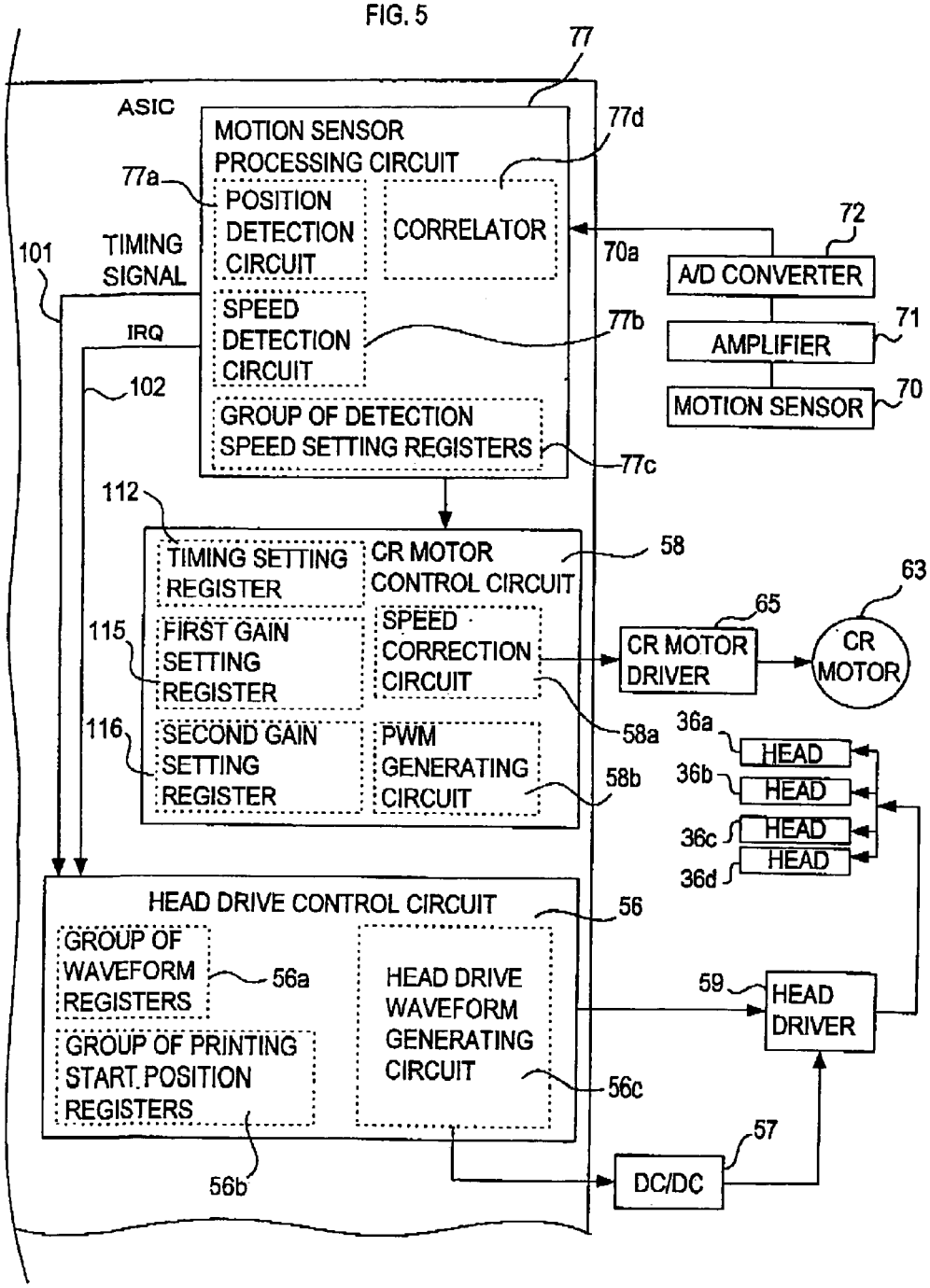
FIG. 5 is an explanatory view showing the structure of the controller 50 in the ink jet printer 1 of Embodiment 1.

The control mechanism 50 is provided with au ASIC (Application Specific IC) 54 which is a type of custom logic IC for controlling drive system components of the ink jet printer 1, as shown in FIG. 4. The ASIC 54 is provided with the motion sensor processing circuit 77, a CR motor control circuit 58, a head drive control circuit 56, a feed motor control circuit 64, an interruption control circuit 80, a bus control/DMA controller 81 and an I/F control circuit 82.

The control mechanism 50 is also provided with a CPU 51 for controlling the ink jet printer 1, a ROM 62 for recording control programs to be executed by the CPU 51, initial values, after-mentioned head drive waveforms and the like, and a RAM 53 for storing graphic information, various setting information and the like. These components are interconnected through a data bus 55*b* and an address bus 55*a*. Also, a paper edge detection sensor 42 is connected to the CPU 51.

The CPU 51, the ROM 52 and the RAM 53 are connected also to the ASIC 54 through the data bus 55*b* and the address bus 55*a*.

Furthermore, the motion sensor 70 for detecting the position of the not-shown carriage 31, a CR motor driver 65 for controlling the CR motor 63 to reciprocate the not-shown carriage 31 in the main scanning direction, a head driver 59 for controlling the print head 36*a* for ejecting yellow ink and print heads 36 (the print head 36*b* for ejecting cyan ink, the print head 36*c* for ejecting magenta ink, the print head 36*d* for ejecting black ink), and a feed motor driver 66 for controlling a feed motor 62 to feed the paper P in a sub scanning direction are connected to the ASIC 54. In addition, a HOST I/F 83 as an interface for mediating communication of data with a not-shown external device such as a computer is connected to the ASIC 54.

The detailed structures of the motion sensor processing circuit 77, the CR motor control circuit 58 and the head drive control circuit 56 in the ASIC 54 will now be described with reference to FIG. 5. FIG. 5 is a block diagram showing the detailed structure of the ASIC 2.

① As shown in FIG. 6, the motion sensor processing circuit 77 in ASIC 54, which is provided with a position detection circuit 77*a*, a speed detection circuit 77*b* and a group of detection speed setting registers 77*c*, is designed to receive input of an image signal 70*a* from the motion sensor 70.

The position detection circuit 77*a* detects the relative position between the paper P and the motion sensor 70 by using the image signal 70*a*.

Specifically, a speckle pattern appearing in the image signal 70*a* is compared chronologically at a specified timing and the moving amount of the speckle pattern is measured. Then, the relative moving amount between the paper P and the motion sensor 70 is calculated by multiplying the moving amount of the speckle pattern by a predetermined coefficient. The relative position between the paper P and the motion sensor 70 can be detected by accumulating the relative moving amount.

The relative position between the paper P and the motion sensor 70 means the position of the paper P in the feed path when the carriage 31 is stopped (i.e. the motion sensor 70 is stopped) and the paper P is being fed, while meaning the position of the carriage 31 in the main scanning direction when the feeding of the paper P is stopped and the carriage 31 is moving in the main scanning direction.

In other words, the position detection circuit 77*a* detects the position of the paper P in the feed path and the position of the carriage 31 in the main scanning direction.

The speed detection circuit 77*b* detects the relative moving speed between the paper P and the motion sensor 70.

Specifically, the relative moving speed between the paper P and the motion sensor 70 is detected based on the relative moving amount detected by the position detection circuit 77*a* and the time necessary for the movement.

The relative moving speed between the paper P and the motion sensor 70 means the feeding speed of the paper P in the feed path when the carriage 31 is stopped (i.e. the motion sensor 70 is stopped) and the paper P is being fed, while meaning the moving speed of the carriage 31 in the main scanning direction when the feeding of the paper P is stopped and the carriage 31 is moving in the main scanning direction.

In other words, the speed detection circuit 77*b* detects the feeding speed of the paper P and the moving speed of the carriage 31 in the main scanning direction.

② The CR motor control circuit 58 in the ASIC 54 is provided with a speed correction circuit 58*a* for correcting the moving speed of the carriage 31 and a PWM (Pulse-Wave-Modulation) generating circuit 58*b* for generating waveform data of PWM control for performing PWM control of the CR motor 63. The CR motor control circuit 58 is connected to the CR motor driver 65, and, in turn, the CR motor driver 65 is connected to the CR motor 63. Accordingly, the waveform data of PWM control is transmitted from the CR motor control circuit 58, and the CR motor driver 65 performs PWM control of the CR motor 63.

③ The head drive control circuit 56 in the ASIC 54 is provided with a head drive waveform generating circuit 66*c* that generates head drive waveforms for driving the print heads 36*a*, 36*b*, 36*c* and 36*d* for printing, a group of waveform registers 56*a* for storing data of head drive waveforms to be generated by the head drive waveform generating circuit 56*c*, and a group of printing start position registers 56*b* for storing data of printing start positions. A head driver 59 for controlling the print heads 36*a*, 36*b*, 36*c* and 36*d* and a DC/DC converter 57 for supplying the head driver 59 with a voltage to be provided to the print heads 36*a*, 36*b*, 36*c* and 36*d* are connected to the head drive control circuit 56.

Figure 6A:
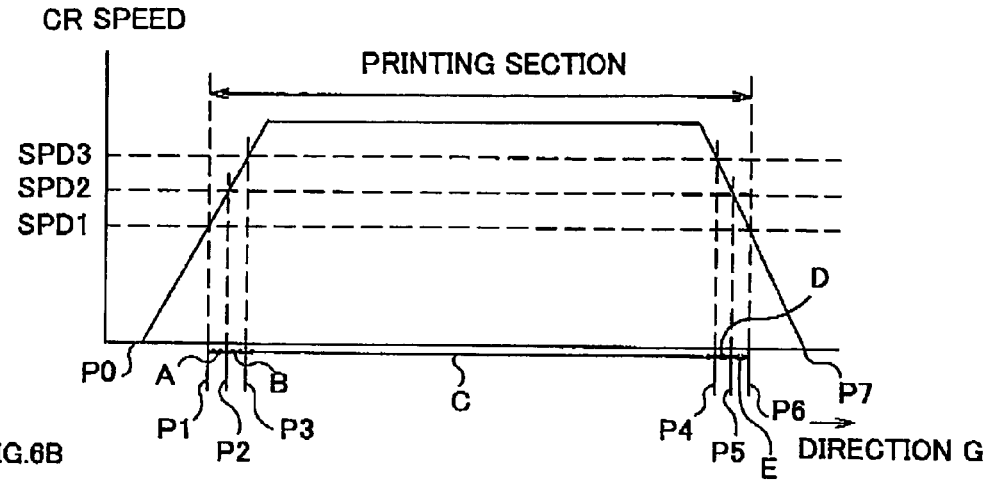
FIG. 6A and FIG. 6B are explanatory views showing the operation of a carriage 31 in the ink jet printer 1 of Embodiment 1.
Figure 6B:
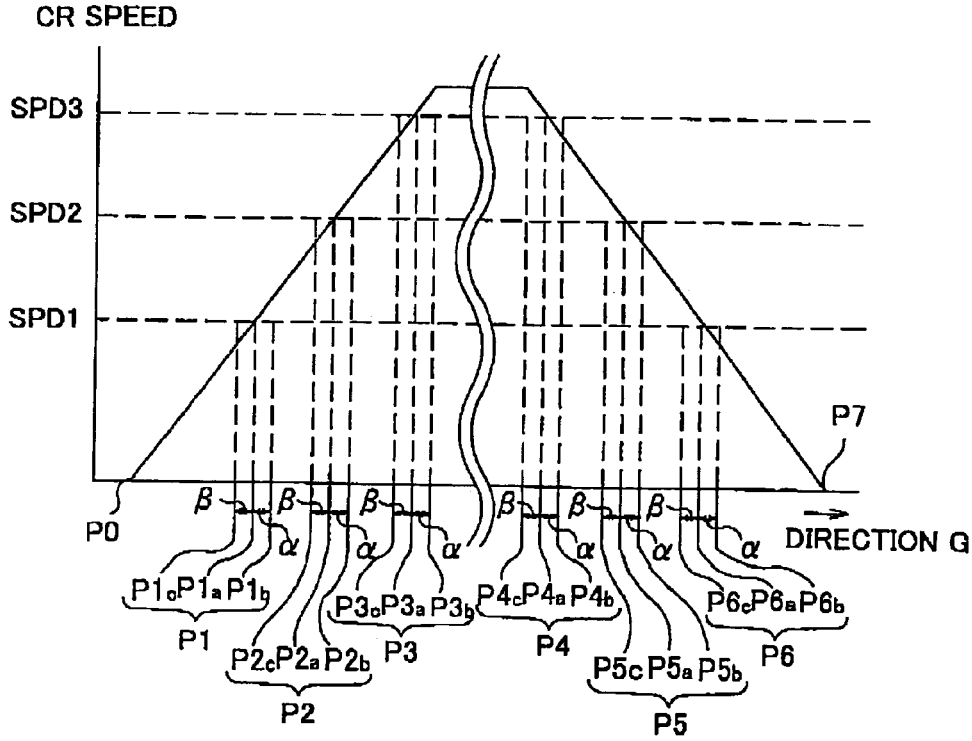
Figure 8:
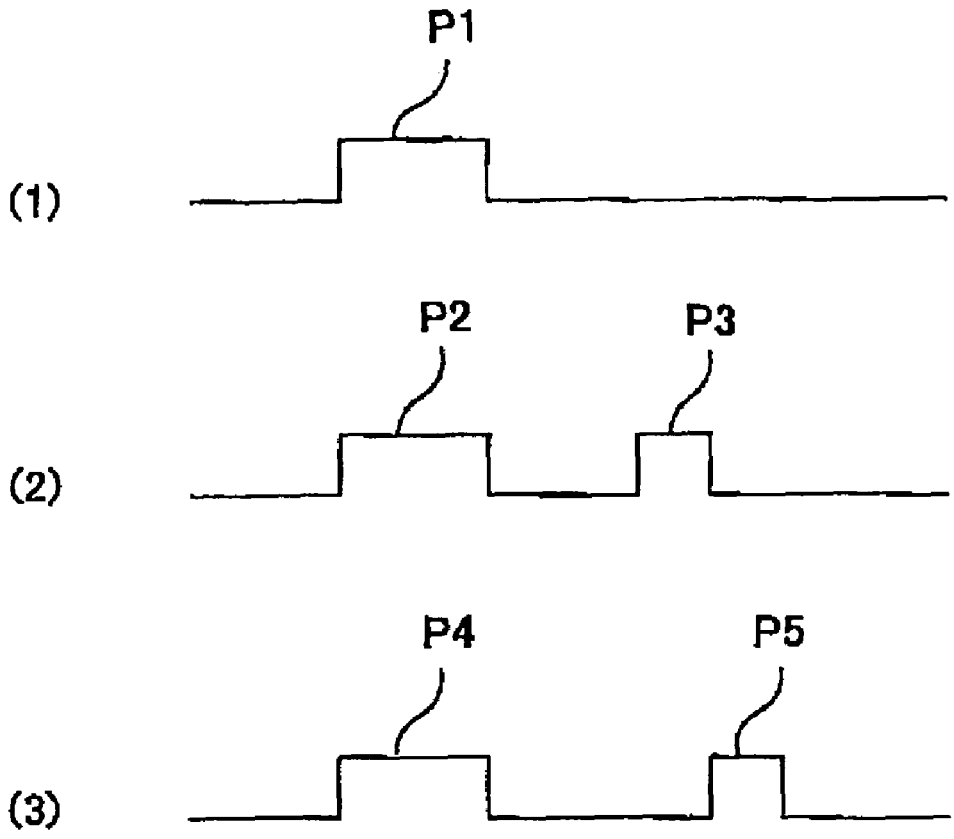
FIG. 8 is an explanatory view showing the operation of the carriage 31 in the ink jet printer 1 of Embodiment 1.

The head drive control circuit 56 is configured such that timing signals are provided from the motion sensor processing circuit 77 through a signal line 101 and interruption signals are provided through a signal line 102.

f) The operation of the carriage 31 will now be described using FIGS. 6-8. FIG. 6A and FIG. 6B are views illustrating the relationship among the position, the speed and the printing section of the carriage 31 of the ink jet printer 1 in the main scanning direction. FIG. 7 is a diagram illustrating the relationship among the position, the speed and the head drive waveform of the carriage 31 of the ink jet printer 1. FIG. 8 is a diagram showing an example of head drive waveforms, In the ink jet printer 1 of Embodiment 1, the position and the speed of the carriage 31 in the main scanning direction are detected by the motion sensor processing circuit 77. Then, the movement of the carriage 31 and the printing are controlled by using the detected position and speed as described below.

i) Firstly, the schematic operation of the carriage 31 during printing will be described using FIG. 6A.

① During printing, the carriage 31 moves from an initial position (P0) in a moving direction of the carriage 31 during printing (hereinafter "Direction G") at an accelerating speed until arriving at a position P1. The carriage 31 does not perform printing in the section from P0 to P1.

P0 is a predetermined position, while P1 is a position to be determined by using the position and speed of the carriage 31. The process of determining P1 will be described later in detail. After-mentioned P2-P6 are also positions to be determined by using the position and speed of the carriage 31.

② Once arriving at the position P1, the carriage 31 starts printing and advances at a further accelerating speed until arriving at a position P2. In the section from the position P1 to the position P2 (Section A), "Waveform 1" is adopted as the head drive waveform, as shown in FIG. 7, and the print heads 36*a-d* are driven.

③ In the section from the position P2 to a position P3 (hereinafter referred to as "Section B"), the carriage 31 moves at a further accelerating speed. In Section B, "Waveform 2" is adopted as the head drive waveform, as shown in FIG. 7, and the print heads 36*a-d* are driven.

④ In the section from the position P3 to a position P4 (hereinafter referred to as "Section C"), the carriage 31 moves at an approximately constant speed. In Section C, "Waveform 3" is adopted as the head drive waveform, as shown in FIG. 7, and the print heads 36*a-d* are driven.

⑤ In the section from the position P4 to a position P5 (hereinafter referred to as "Section D"), the carriage 31 moves at a decelerating speed. In Section D, "Waveform 2" is adopted as the head drive waveform, as shown in FIG. 7, and the print heads 86*a-d* are driven.

⑥ In the section from the position P5 to a position P6 (hereinafter referred to as "Section E"), the carriage 31 moves at a decelerating speed. In Section E, "Waveform 1" is adopted as the head drive waveform, as shown in FIG. 7, and the print heads 36*a-d* are driven.

⑦ In the section from the position P6 to a position P7 at which the carriage 31 turns back, printing is not performed.

ii) Next, determination of a section in which printing is performed and the positions P1 P6 as a basis for changing the head drive waveform to be used will be described by using FIG. 6B.

P1 is determined based on the timing at which the speed of the carriage 31 that starts from the position P0 and moves in Direction G at an accelerating speed reaches SPD1, and on the deviation amount of the paper P. (Measurement of the deviation amount will be described later.)

In the case where the paper P moves without deviation, the position of the carriage 31 when the speed of the carriage 31 reaches SPD1 (P1*a* in FIG. 6B) is P1.

In the case where the paper P moves with a deviation in Direction G, a position (P1*b* in FIG. 6B) shifted from the position P1*a* in Direction G by an accumulated value (α) of the deviation amount of the paper P at the point in time is P1.

In contrast, in the case where the paper P moves with a deviation in a direction opposite to Direction G, the position shifted from the position P1*a* in a direction opposite to Direction G by an accumulated value (β) of the deviation amount of the paper P at the point in time (P1*c* in FIG. 6B) is P1.

In a specific process of determining P1, the position and speed of the carriage 31 are first detected by the motion sensor processing circuit 77 by using an image signal 70*a* provided from the motion sensor 70.

Subsequently, the position (P1*a*) at which the speed of the carriage 31 reaches SPD1 is calculated by using the above position and speed, and P1 is determined by shifting the position (P1*a*) by the accumulated value (α or β) of the deviation amount of the paper P.

In the same manner, P2-P6 are determined as respective positions at which the speed of the carriage 31 reaches a given speed in the case where the paper P moves without deviation. Specifically, P2 is a position at which the accelerating speed of the carriage 31 reaches SPD2, P3 is a position at which the accelerating speed of the carriage 31 reaches SPD3, P4 is a position at which the decelerating speed of the carriage 31 falls below SPD3, P5 is a position at which the decelerating speed of the carriage 31 falls below SPD2, and P6 is a position at which the decelerating speed of the carriage 31 falls below SPD1.

In the case where the paper P moves with a deviation, in the same manner as P1 described above, P2-P6 are determined, respectively, as positions (P2*b*-P6*b* or P2*c*-P6*c*) which are shifted from the positions of P2-P6 in the case without deviation (i.e. P2*a*-P6*a*) by an accumulated value (α or β) of the deviation amount of the paper P at the point in time That is, the respective printing start positions are shifted in the carriage feed direction by an amount equal to the accumulated value of the deviation amount, which can eliminate the effects of the deviation.

iii) Next, an example of the head drive waveforms, i.e. Waveform 1, Waveform 2 and Waveform 3, will be described with reference to FIG. 8. The print heads 36*a-d* are described here as ink jet heads.

As shown in FIG. 8(1), Waveform 1 is a waveform including only a drive pulse P1 that drives the ink jet heads. Waveform 2 is a waveform including a drive pulse P2 that drives the ink jet heads and a cancel pulse P3 that cancels residual oscillation of the ink jet heads in ink channels. Waveform 3, which is a waveform including a drive pulse P4 that drives the ink jet heads and a cancel pulse P5 that cancels residual oscillation of the ink jet heads in the ink channels, has a greater interval between the drive pulse P4 and the cancel pulse P5 as compared with the case of Waveform 2. Since the residual oscillation in the ink channels is cancelled by the cancel pulses P3, P5, higher speed printing operation can be achieved. The waveform data of Waveform 1 through Waveform 3 is stored in the ROM 52.

A plurality of waveforms having basically the same form but different amplitudes of drive pulses for driving the ink jet heads are stored in the ROM 52 with respect to Waveform 1, Waveform 2 and Waveform 3, respectively.

Specifically, Waveforms 1*a*-1*c* with different amplitudes of P1 are stored with respect to Waveform 1, Waveforms 2*a*-2*c* with different amplitudes of P2 are stored with respect to Waveform 2, and Waveforms 3*a*-3*c* with different amplitudes of P5 are stored with respect to Waveform 3.

It is determined which of Waveforms 1*a*-1*c* in Waveform 1 should be used for driving heads, depending on the type of the paper. In each case of Waveform 2 and Waveform 3, it is also determined which of the waveforms should be used, depending on the type of the paper.

g) The printing process of the ink jet printer 1 will now be described using FIGS. 9 to 16.

Figure 9:
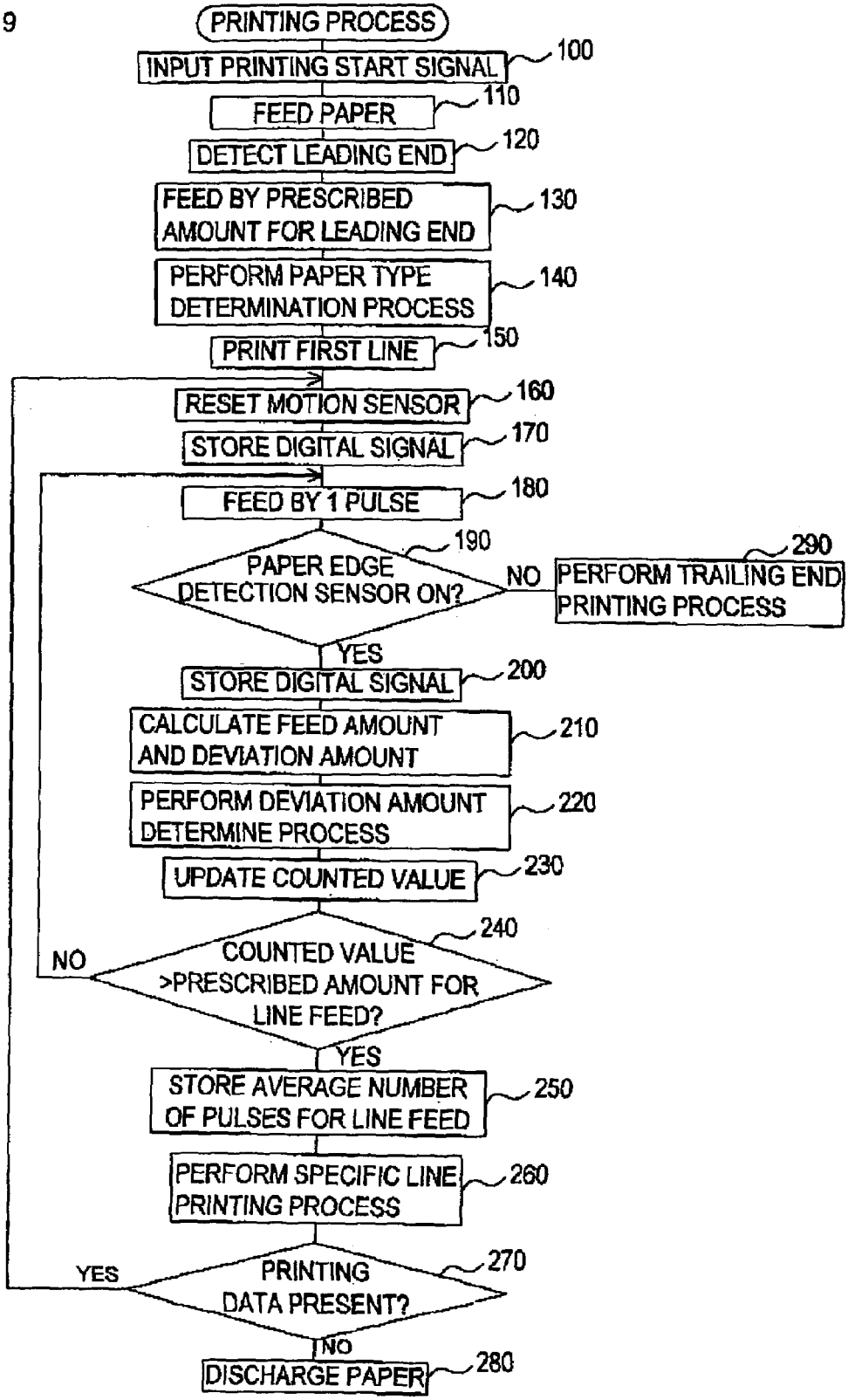
FIG. 9 is a flowchart showing a printing process performed by the ink jet printer 1 of Embodiment 1.

In Step 100, as shown in FIG. 9, a printing start signal and printing data (dot pattern data) are input from the external electronic device through the Host I/F 83 into the control mechanism 50. The input printing data is stored in the RAM 53.

In Step 110, the paper P is taken out from the paper feed cassette 11 and is fed along the feed path 4.

More particularly, the feed motor driver 66 of the data control mechanism 50 sends a driving signal to the feed motor 62. The driving force of the feed motor 62 is transmitted to the paper feed roller 14 of the paper supply mechanism 10 through the driving mechanism. The driven paper feed roller 14 takes out the paper P sheet by sheet from the paper feed cassette 11 and feeds the sheet to the feed path 4.

Upon detection of the leading end of the paper P in Step 120 by the paper edge detection sensor 42, in Step 130, the paper feed roller 14 further rotates by a specified amount so that the leading end of the paper P hits against a nip of the first feed roller 21 and the follower roller 22 to cause so-called resist actions; then the feed motor 62, in turn, is rotationally driven in the reverse direction to cause the first feed roller 21, which has been rotating in a counter-clockwise direction in FIGS. 1 and 2, to start rotating in a clockwise direction by a specified amount (a prescribed amount for a leading end) to feed the paper P until the head of a printing area of the paper P is placed right under the print head 36 of the print mechanism 30. Thereafter, the first feed roller 21 and the paper P temporarily stop.

It should be noted that since the driving force of the feed motor 62 is not transmitted to the paper feed roller 14 when the first feed roller 21 is rotationally driven in a clockwise direction by the feed motor 62, no adverse effect will be caused to the feeding of the paper P accompanying the rotation of the first feed roller 21.

In Step 140, paper type determination process is performed.

The paper type determination process will be described by using FIG. 10 and FIG. 11.

In Step 300, image signals 70*a* output by the motion sensor 70 are captured five times, and the captured image signals are stored in the RAM 63.

In Step 310, the five image signals 70*a* stored in Step 300 are averaged to create average data.

In Step 320, pattern recognition of the average data created in Step 310 is performed.

Figure 11:
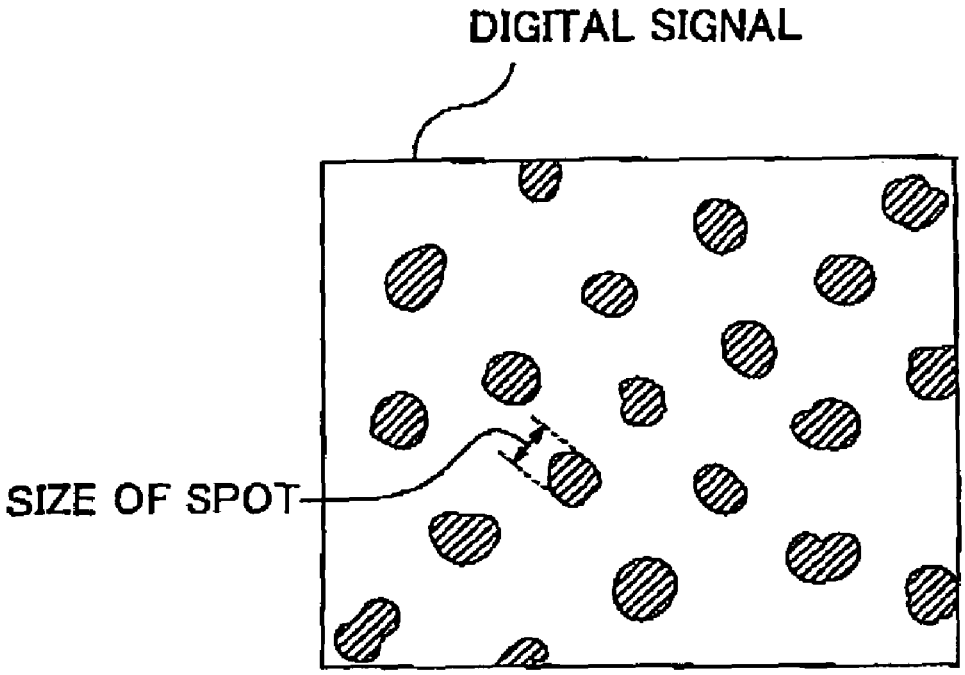
FIG. 11 is an explanatory view showing a method for detecting the type of paper during the paper type determination process performed by the ink jet printer 1 of Embodiment 1.

Specifically, the average data includes, as shown in FIG. 11, a speckle pattern corresponding to the surface shape of the paper at the point where the laser light has been reflected, and the speckle pattern (e.g. the size, the density of the speckle pattern) is detected by using a pattern recognition method.

In Step 330, a reference pattern closest to the pattern of the average data detected in Step 320 is selected. Reference patterns are speckle patterns corresponding, respectively, to various types of paper and previously stored in the ROM 52.

In Step 340, it is determined whether the difference between the reference pattern selected in Step 330 and the pattern of the average data is within a specified value. If YES, the process proceeds to Step 350, while if NO, the process proceeds to Step 360.

In Step 350, the type of paper P is determined based on the reference pattern selected in Step 330. Specifically, it is determined that type of the paper P is a type of paper corresponding to the reference pattern selected in Step 330. The type of paper determined as above is stored in the RAM 53. The type of paper stored in the RAM 53 will be used in selecting the head drive waveform during the after-mentioned specific line printing process.

When the process in Step 350 is finished, the paper type determination process is terminated and the process proceeds to Step 150 in the printing process (FIG. 9).

In contrast, if it is determined in Step 340 that the difference between the reference pattern and the pattern of the average data is beyond the specified value, the process proceeds to Step 360. In Step 360, a warning that the type of the supplied paper is improper is indicated on the display portion (not shown) of the ink jet printer 1 or on the display of the external device (the host computer), and the printing process is stopped.

Returning to the printing process (FIG. 9), printing of the printing data corresponding to the first line is performed by using the print mechanism 30 with the paper P in a suspended state in Step 160. In other words, printing is performed by the CR motor driver 65 driving the CR motor 63 to make the carriage 31 operate on the basis of the printing data stored in the RAM 58, and by outputting the head drive waveform from the head drive control circuit 56 to the head driver 59 to drive the print heads 36.

In Step 150, the head drive waveform is selected in accordance with the type of paper determined in Step 140 so as to change a printing condition (the amount of ink droplets ejected by the print heads 36).

In Step 160, the counted value stored in the RAM 53 is reset as a preparation for executing a later-mentioned process (i.e. a process of determining whether the counted value in Step 160 or later has reached a prescribed amount for line feed). The counted value, which is a parameter that is counted up on the basis of signals output from the motion sensor 70, will be described in detail later.

In Step 170, an image signal 70*a* (a paper position signal) related to the position of the paper P is detected by using the motion sensor 70 and is stored in the RAM 53 (execution of paper position signal generating device).

More particularly, a laser beam from the semiconductor laser 74 of the motion sensor 70 is irradiated onto the surface of the paper P, and the reflected light is detected by the two-dimensional semiconductor image sensor 76. The two-dimensional semiconductor image sensor 76 performs photoelectric conversion of the reflected light to generate an image signal 70*a*, and stores the image signal 70*a* in the RAM 63.

In Step 180, the paper P is fed in the downstream direction by driving the feed motor 62 by a single pulse.

In Step 190, it is determined whether or not the paper edge detection sensor 42 has detected the trailing end of the paper P (that is, whether the trailing end of the paper P in the feed direction has not yet passed the paper edge detection sensor 42 or already has).

If the answer is NO (if the paper edge detection sensor 42 is on), the process proceeds to Step 200. If the answer is YES (if the paper edge detection sensor 42 is off), the process proceeds to Step 290.

In Step 200, an image signal 70*a* related to the position of the paper P is stored in the RAM 53 in the same manner as in Step 170 (execution of paper position signal generating device).

In Step 210, the newest signal and the next newest signal among the image signals 70*a* that have been stored in the RAM 53 either in Step 170 or in Step 200 are used for performing calculation in the motion sensor processing circuit 77, and the feed amount by which the paper P has been fed in the feed direction and the deviation amount by which the paper P has been moved in the direction perpendicular to the feed direction in Step 180 are calculated (execution of the paper feed amount detection device and the deviation detection device).

A detailed description will now be made below using FIG. 12.

The image signal 70*a* that is stored in the RAM 53 in Step 170 or Step 200 includes each speckle pattern corresponding to the surface shape at the point where the laser light is reflected (the surface of the paper P).

When the paper P is fed, the point at which laser light is reflected is shifted, and the speckle pattern in the image signal 70*a* is moved so as to correspond to the feeding of the paper P.

In other words, the speckle pattern before the feeding of the paper P is moved to the speckle pattern after the feeding of the paper P by an amount corresponding to the feed amount of the paper P.

Accordingly, the moving amount of the paper P can be calculated on the basis of measured results obtained by measuring the moving amount of the speckle pattern accompanying the feeding of the paper P.

Figure 12:
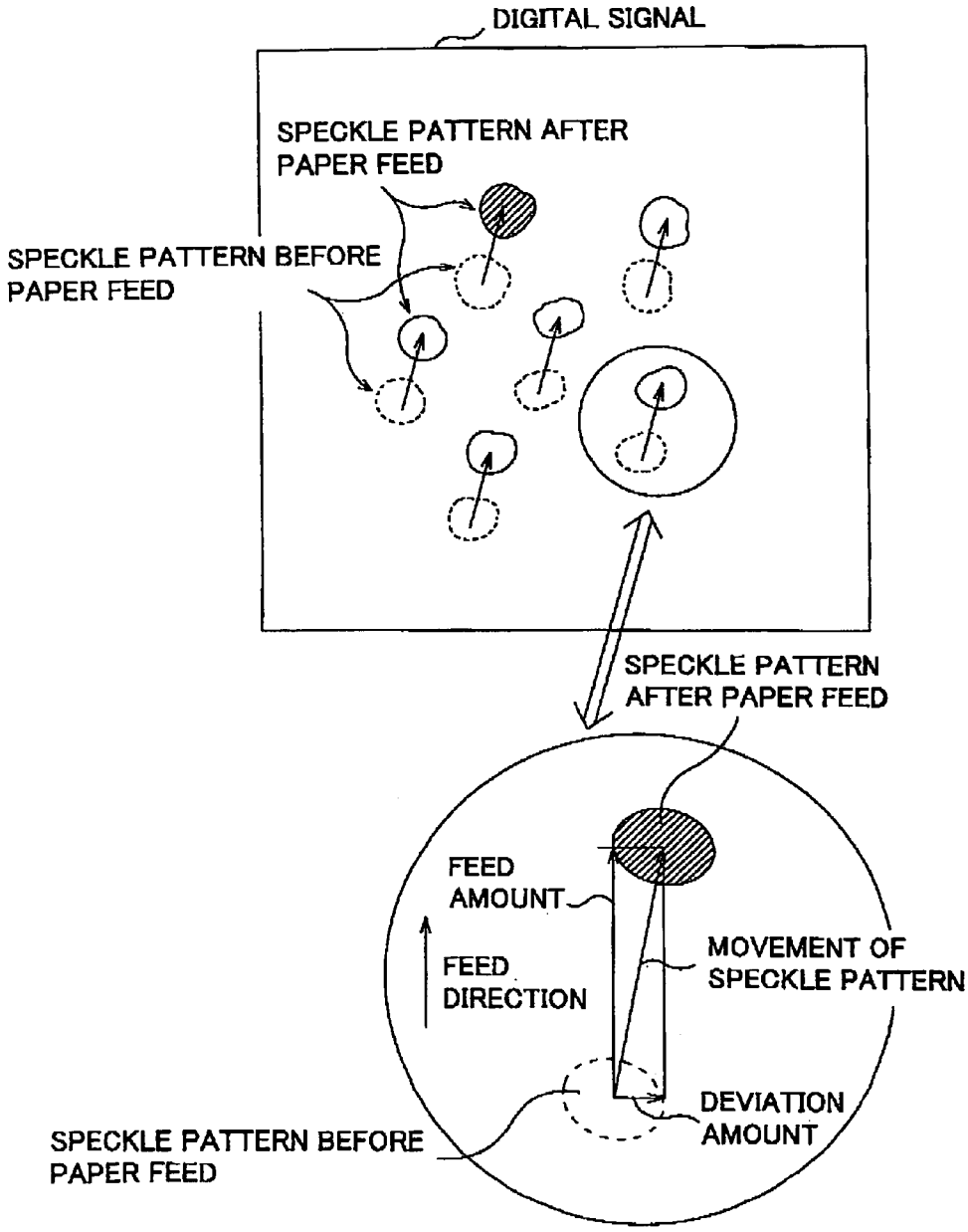
FIG. 12 is an explanatory view showing a method for detecting the feed amount and the deviation amount of the paper during the printing process performed by the ink jet printer 1 of Embodiment 1.

Thus, in this Step 210, speckle patterns of the respective image signals 70*a* stored in the RAM 53 before and after the feeding of the paper P (Step 180) are first compared as illustrated in FIG. 12 for measuring the moving amount of the speckle pattern. Then, the moving amount of the paper P in Step 180 is calculated on the basis of the measurement result.

The component in the feed direction of the movement of the paper P is defined as the feed amount, while the component in the direction perpendicular to the feed direction is defined as the deviation amount. The feed amount and the deviation amount are stored in the RAM 53.

Figure 18:
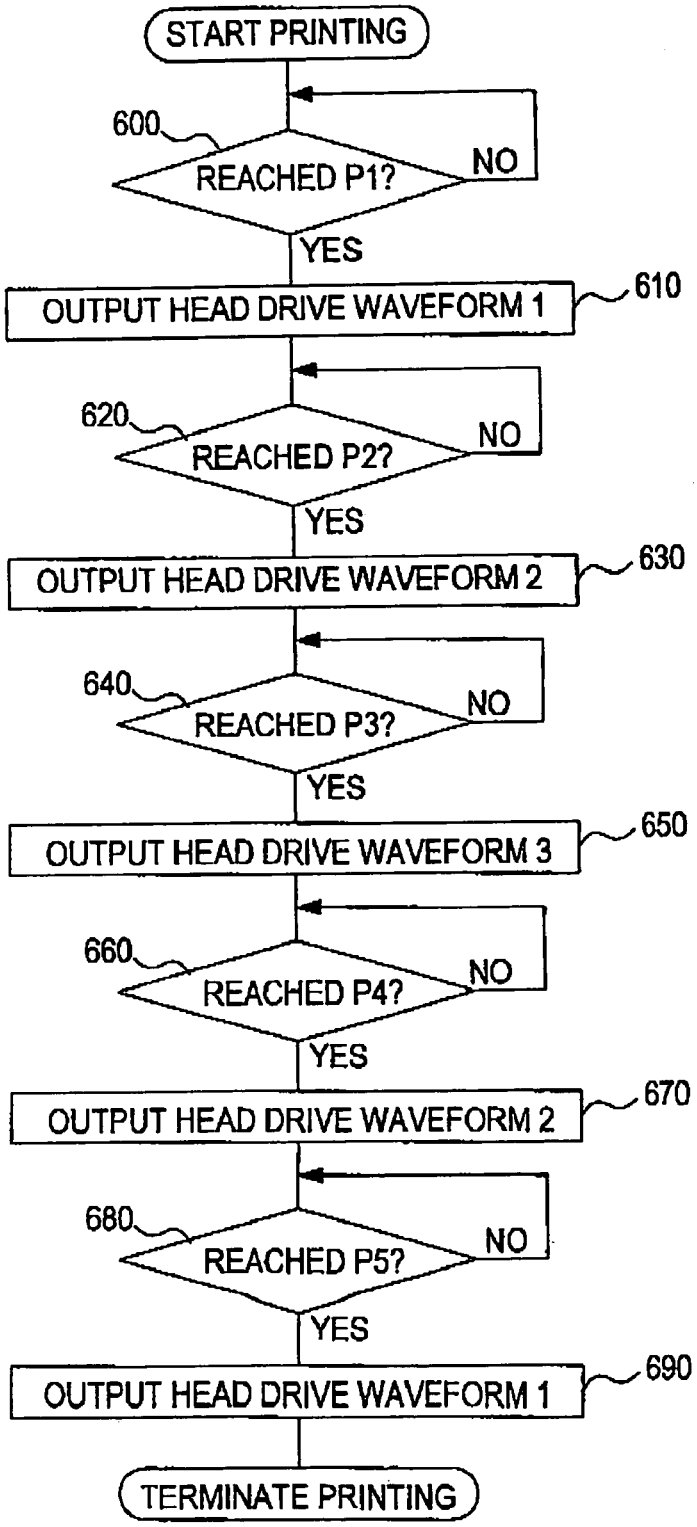
FIG. 18 is an explanatory view showing the specific line printing process performed by the ink jet printer 1 of Embodiment 1.

Now, the calculation process of the feed amount described using FIG. 12 will be described based on FIG. 18.

The motion sensor 70 detects the speckle patterns continuously and sends speckle pattern information converted into digital signals through the amplifier 71 and the A/D converter 72 to the correlator 77*d* (S361).

The correlator 77*d* adjusts the threshold value to extract characteristic points (S362), and specifies several characteristic points (S363).

If the specification of characteristic points is normally completed (S363: YES), the moving direction and the moving amount of the characteristic points are calculated based on the speckle pattern information and the resolution of the photoreceptor by comparison between the previous data and the current data of the characteristic points which move in accordance with the movement of an object to be observed (S364). Subsequently, by multiplying the moving amount calculated in S364 by a predetermined correction factor with respect to the actual moving amount of the paper, the feed amount is calculated (S365). Then, the current data of the characteristic points is stored so as to replace the previous data of the characteristic points (S366), a characteristic point detection error counter (described in detail later) is cleared (S367), and the entire process is terminated.

The case where the specification of characteristic points is not normally completed in S363 (S363: NO) is, for example, the case where characteristic points cannot be specified in the graphic information in spite of adjusting the threshold value because of the influence of noises, and the like.

Subsequently, the characteristic point error counter for counting the number of characteristic point detection errors is incremented (S368). If the characteristic point detection error counter indicates the number greater than 20, that is, the characteristic point detection ends up with twenty-one consecutive errors (S369: YES), a moving amount detection error is determined and error handling such as informing the user of the error and stopping the operation of the device is performed. On the other hand, if the characteristic point detection error counter indicates the number equal to or less than 20 (S369: NO), the moving amount is determined as 0 without calculating the actual moving amount (S370) and the process is terminated.

Thus, it is possible to prevent an incorrect moving amount provided by a detection error from being used for input of feedback control.

The above described processes are executed at each sampling frequency for calculation of the moving amount. The sampling frequency for calculation of the moving amount is set within a time (approximately several dozen μs) short enough for the characteristic points not to move out of a detection area to be detected by the photoreceptor even when the paper and the motion sensor 70 are relatively moved at a predetermined maximum speed. Calculation and addition of the moving amount from the position where the previous call was made is continued until this processing routine is called by an interrupt or the like.

Returning to FIG. 9, in Step 220 a deviation amount determination process is executed based on the deviation amount calculated in Step 210.

Figure 14:
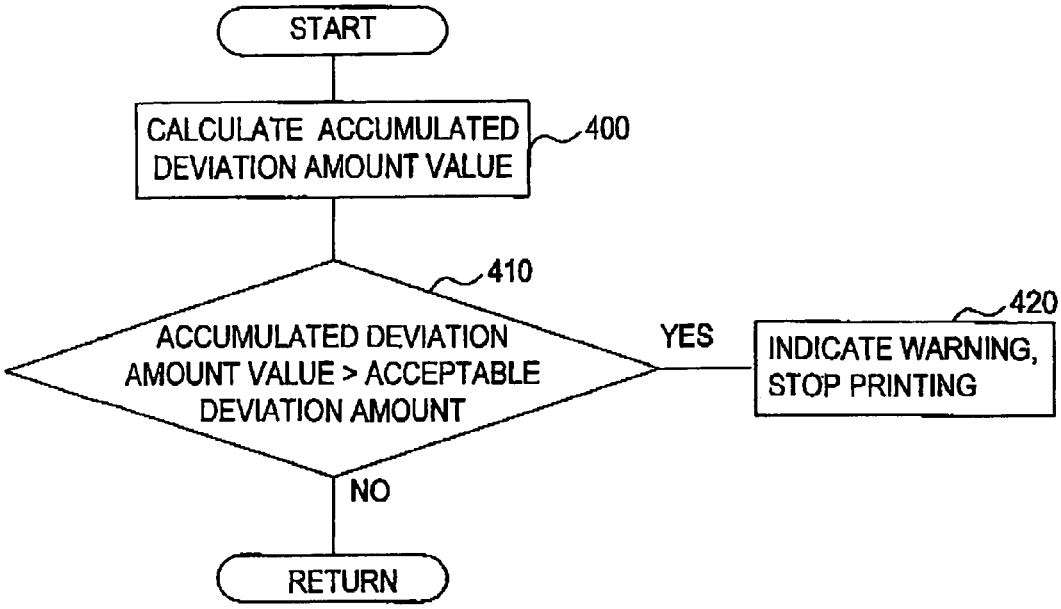
FIG. 14 is an explanatory view illustrating a deviation amount determination process performed by the ink jet printer 1 of Embodiment 1.

The deviation amount determination process will be described by using FIG. 14.

In Step 400, an accumulated deviation amount value is updated by adding the deviation amount calculated in Step 210 to the accumulated value of the deviation amount (the accumulated deviation amount value) at the time of the previous process. That is, the accumulated deviation amount value updated in Step 400 is the total of the deviation amounts from the time when the printing process is started.

In Step 410, it is determined whether or not the accumulated deviation amount value has reached a prescribed acceptable deviation amount. In the case of YES, the process proceeds to Step 420. In Step 420, a warning is indicated on a display portion (not shown) of the ink jet printer 1, and the printing process is terminated.

In the case of NO in Step 410, the process returns to the main routine in FIG. 9.

After returning to the main routine of the printing process (FIG. 9), in Step 230, the feed amount of the paper P as calculated in Step 200 is added to the counted value, which is a parameter stored in the RAM 53 (an accumulated value of the feed amount of the paper P when Step 230 was executed the last time), to update the counted value. The counted value is a value to be reset in Step 160 as described above.

In Step 240, it is determined whether or not the counted value updated in Step 230 has reached a prescribed amount for line feed (a length of the nozzle portions of the print head 36: for instance, 1 inch). If the counted value has reached the prescribed amount for line feed, the process proceeds to Step 250, while if the counted value has not reached the prescribed amount for line feed yet, the process proceeds to Step 180.

In Step 250, the number of times for which driving by a single pulse (Step 180) has been performed since the immediately preceding printing (Step 160 or Step 260) is stored in the RAM 53 as the number of pulses for line feed.

Further, an average value of the numbers of pulses for line feed counted since the start of the printing process is calculated as an average number of pulses for line feed and is stored in the RAM 53.

In Step 260, a specific line printing process is performed.

Figure 15:
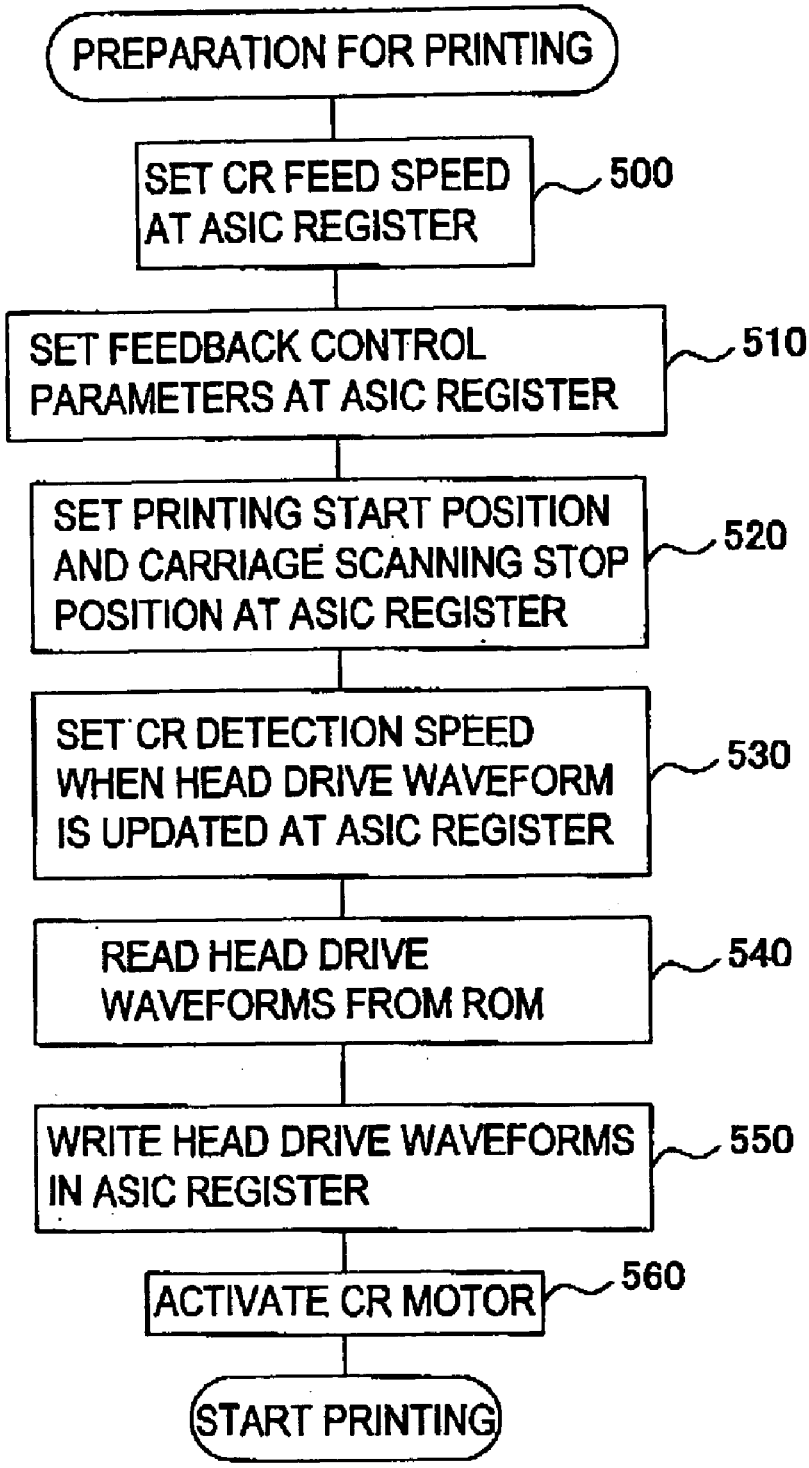
FIG. 15 is an explanatory view showing a specific line printing process performed by the ink jet printer 1 of Embodiment 1.

The specific line printing process is a process to print a single line using the carriage 31. The process will be described below by using FIG. 15 to FIG. 18. FIG. 15 is a flowchart showing the preparation for printing, while FIG. 18 is a flowchart showing the operation of the carriage 31 during printing.

The preparation for printing will be described with reference to FIG. 15.

In Step 600, a carriage feeding speed, at which the carriage 31 is moved for performing printing, is read from the ROM 62, and is set at a group of detection speed setting registers 77*c* in the motion sensor processing circuit 77 of the ASIC 54.

In Step 510, parameters for performing feedback control to allow a stable movement of the carriage 31 at a constant speed are read from the ROM 52, and are set at the group of detection speed setting registers 77*c* in the motion sensor processing circuit 77 of the ASIC 54.

In Step 520, in accordance with the format information of printing included in the printing data stored in the RAM 53, a printing start position and a carriage scanning stop position are set at a group of printing start position registers 56*b* in the head drive control circuit 56 of the ASIC 54.

In Step 530, the speed of the carriage 31 (hereinafter referred to as the "CR detection speed") serving as a basis for determining the positions P1 to P6, at which the head drive waveform is updated (switched) during the moving process of the carriage 31, is read from the ROM 52, and is set at the group of detection speed setting registers 77*c* in the motion sensor processing circuit 77 of the ASIC 54. The CR detection speed specifically includes three types of speeds SPD1-SPD3 as mentioned above.

In Step 540, waveform data about "Waveform 1", "Waveform 2", and "Waveform 3" as the head drive waveforms is read from the ROM 52.

In this case, waveforms to be read with respect to "Waveform 1", "Waveform 2", and "Waveform 3" are selected, respectively, in accordance with the type of the paper P identified in Step 140.

For instance, when the type of the paper P is identified as plain paper in Step 140, "Waveform 1*a*", "Waveform 2*a*", and "Waveform 3*a*" are read from "Waveform 1", "Waveform 2", and "Waveform 3," respectively, while "Waveform 1*b*", "Waveform 2*b*", and "Waveform 3*b*" are read when the type of the paper P is identified as high-resolution printing paper (i.e. super fine paper) in Step 140.

In Step 550, the head drive waveforms read in Step 540 are written to the group of waveform registers 56*a* in the head drive control circuit 56 of the ASIC 54.

In Step 560, the CR motor control circuit 58 activates the CR motor 63 by performing PWM control through the CR motor driver 65, and the carriage 31 starts its movement from the initial position (the position P0 shown in FIG. 6A and FIG. 6B) toward the carriage scanning end position (the position P7 shown in FIG. 6A and FIG. 6B).

Figure 16:
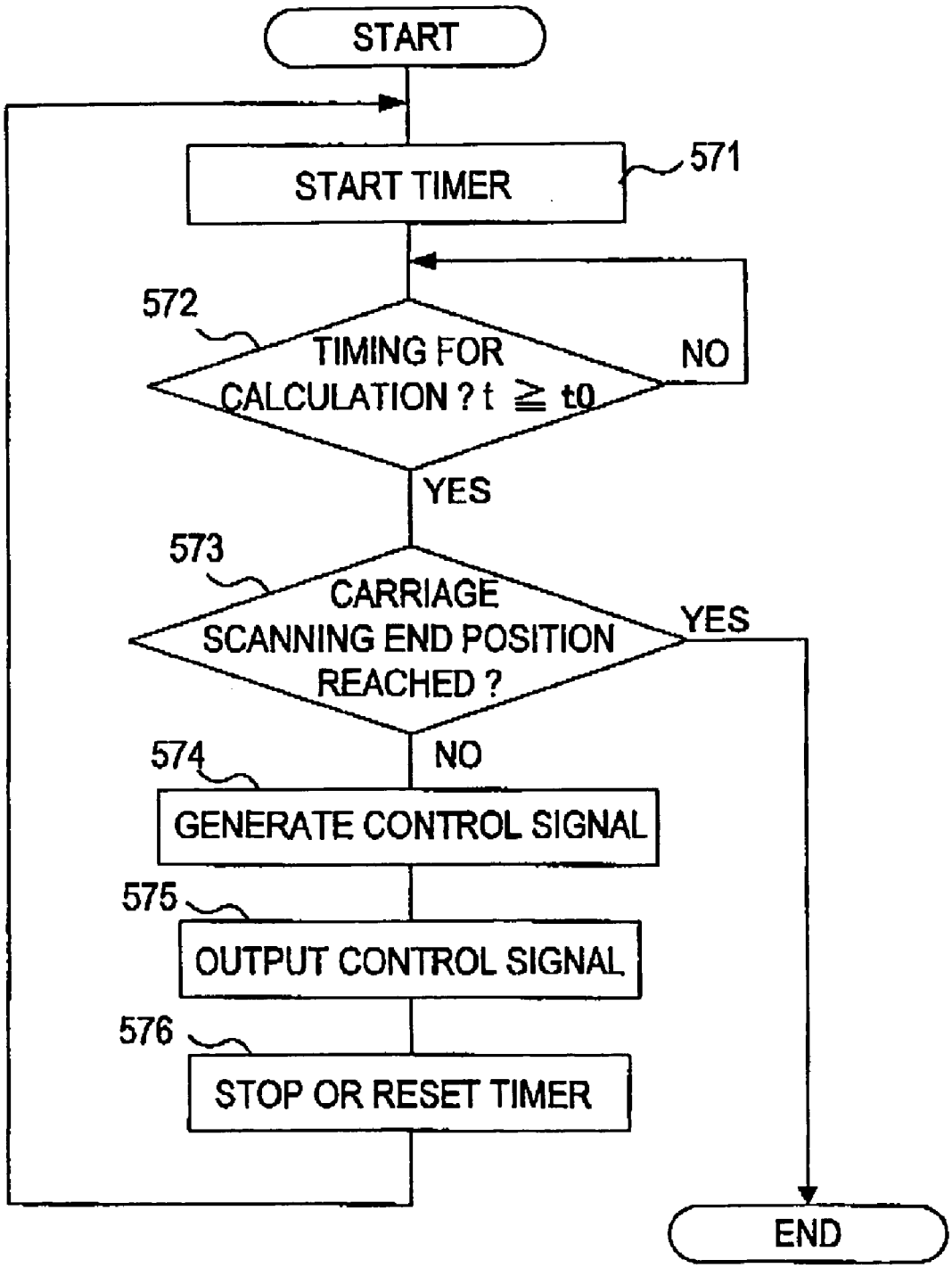
FIG. 16 is a flowchart showing a procedure of controlling a CR motor by a CR motor controlling circuit.

The procedure of controlling the CR motor by the CR motor control circuit 58 will be described below based on FIG. 16. Generation of the control signal according to the procedure is started after the CR motor is activated in the process of S560 in FIG. 15.

Although the CR motor control circuit 58 operates as hardware, the operation as hardware will be described here in the form of a flowchart to facilitate better understanding.

First, the speed correction circuit 58*a* starts a timer (S571). Next, the speed correction circuit 58*a* waits until the timing for calculation has been reached (S572: NO). Specifically, it waits until the measured time t by the timer has reached the time for calculation t0 set in the timing setting register 112 (t<t0).

When the timing for calculation has been reached in the procedure in S572 (S572: YES), the speed correction circuit 58*a* checks whether or not the current position of the carriage 31 has reached the scanning end position (P7) (S573). In this case, it is determined whether or not the carriage 31 has reached the scanning end position by comparing the position calculated by the position detection circuit 77*a* which calculates the position of the carriage 31 based on the feed amount calculation flow in FIG. 13 with the scanning end position (P7).

Figure 13:
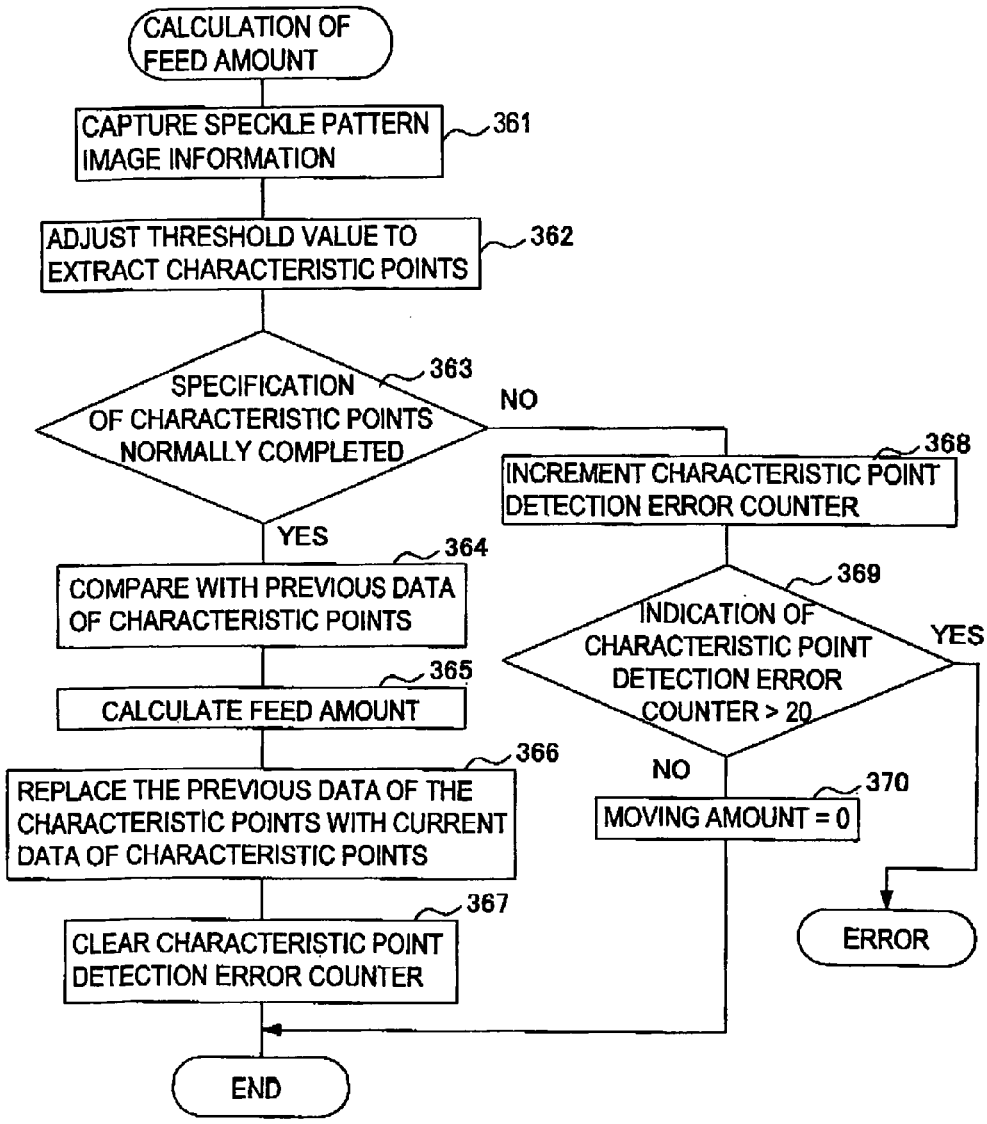
FIG. 13 is a flowchart illustrating a calculation process of the feed amount shown in FIG. 12.

In the procedure of S573, the current position of the carriage 31 is calculated from the moving amount of the carriage 31 with respect to the paper by using the feed amount calculation flow in FIG. 13. If it is determined that the current position of the carriage 31 has not reached the scanning end position (S573: NO), the speed correction circuit 58*a* generates a control signal to be input to the PWM generating circuit 58*b* (S574). The procedure of generating a control signal by the speed correction circuit 58*a* will be described later with reference to FIG. 17. The speed here means a value obtained by dividing the moving amount of the carriage 31 during t0 by the timing (the interval) t0 at which the calculation of the moving amount of the carriage 31 is performed.

Subsequently, the speed correction circuit 58*a* converts the control signal into a PWM signal and outputs the PWM signal to the PWM generating circuit 58*b* (S575).

The speed correction circuit 58*a* then stops and resets the timer (S576), and returns to the procedure in S571.

When it is determined in the procedure in S573 that the current position of the carriage 31 has reached the scanning end position (S573: YES) after the procedures from S571 through S576 are repeatedly performed, the present procedure of generating a control signal is terminated.

Figure 17:
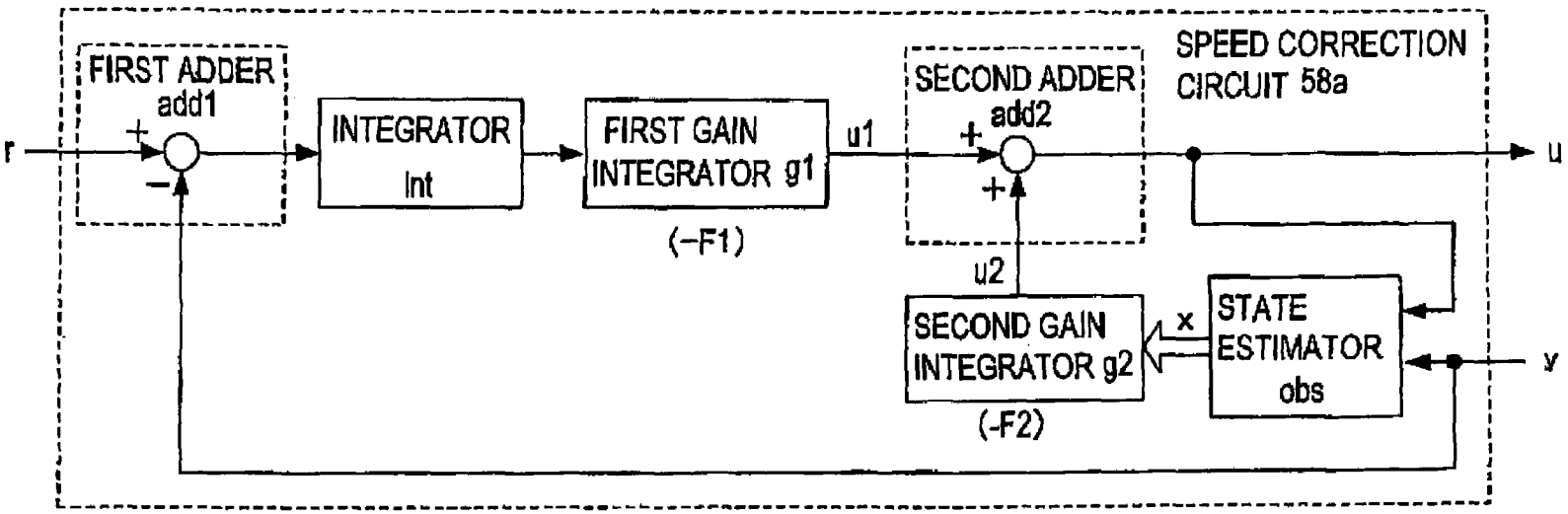
FIG. 17 is an explanatory view illustrating the structure of a speed correction circuit in the CR motor control circuit.

The procedure of generating a control signal by the speed correction circuit 58*a* will be described below based on FIG. 17. The speed correction circuit 58*a* of the CR motor control circuit 58, which is for performing feedback control such that the speed y by the speed detection circuit 77*b* is equal to the carriage moving speed r set in the group of detection speed setting registers 77*c*, comprises a first adder add1, an integrator int, a first gain integrator g1, a state estimator obs, a second gain integrator g2 and a second adder add2.

In the speed correction circuit 58*a*, the deviation (r−y) between the carriage moving speed r set in the group of detection speed setting registers 77*c* and the speed y measured by the speed detection circuit 77*b* is first calculated by the first adder add1.

Then the accumulated value of the deviation ($\int(r-y)dt0$) is calculated by means of the integrator int by discrete integration of the deviation calculated by the first adder add1 with respect to the time for calculation t0 set in the timing setting register 112.

Subsequently, a first control signal having a value "u1 ($=\cdot F1*\int(r-y)dt0$)" obtained by integrating the accumulated value of the deviation calculated by the integrator int and the integral gain F1 set in the first gain setting register 115 is generated by the first gain integrator g1.

By the state estimator obs, the quantity of state x indicating the internal state of the carriage mechanism is estimated based on a control input u indicated by the control signal input to the PWM generating circuit 58*b* and the speed y measured by the speed detection circuit 77*b*.

Then, a second control signal having a value "u2 ($=\cdot F2*x$)" obtained by integrating the quantity of state x estimated by the state estimator obs and the state feedback gain F2 set in the second gain setting register 116 is generated by the second gain integrator g2.

Moreover, a control signal having a value of "u(=u1+u2)" obtained by adding the first and second control signals as a control input u is generated by the second adder add2.

This causes the CR motor 63 to be rotated in a rotating direction at an angular velocity corresponding to the value of the control input u of the control signal, and the carriage 31 is moved in parallel in accordance with the rotation.

The operation of the carriage 31 during printing will now be described with reference to the flowchart in FIG. 18.

In Step 600, it is determined whether or not the position of the carriage 31 starting from the position P0 has reached the position P1.

The position P1 is determined based on the position of the carriage 31 and the accumulated value of the deviation amount of the paper P when the speed of the carriage 31 reaches the speed SPD1 as described above. Specifically, the position is determined as below.

While the position of the carriage 31 is detected by the position detection circuit 77*a* of the motion sensor processing circuit 77 by using the image signal 70*a* from the motion sensor 70, the speed of the carriage 81 is detected by the speed detection circuit 77*b*.

Based on the position and the speed of the carriage 31, the position of the carriage 31 (P1*a*) when the speed of the carriage 31 reaches a prescribed speed SPD1 set to the group of detection speed setting registers 77*c* is calculated.

When the paper P moves without deviation, the position P1*a* is determined as the position P1, while when the paper P moves with deviation, a position (P1*b* or P1*c*) shifted from the position P1*a* by the accumulated value of deviation amount at the point in time is determined as the position P1. As the deviation amount, a value measured in Step 210 and stored in the RAM 53 is used.

If the position of the carriage 31 detected by the position detection circuit 77*a* has reached the position P1 determined as above, a P1 position interrupt signal is sent from the motion sensor processing circuit 77 to the head drive control circuit 56 through a signal line 102, and the process proceeds to Step 610. If the position of the carriage 31 has not reached the position P1, the process returns to Step 600.

In Step 610, Waveform 1 for head driving is read from the group of waveform registers 56*a* of the head drive control circuit 56, and then Waveform 1 is output to the head driver 59 by the head drive waveform generating circuit 56*c*.

Accordingly, the printing operation is performed by the print heads 36*a-d* of the carriage 31 driven by Waveform 1 in Section A shown in FIG. 6A. Waveform 1, which is read in Step 640 depending on the type of the paper identified in Step 140 as described above, is one of Waveform 1*a*, Waveform 1*b* and Waveform 1*c*.

In Step 620, the position P2 is determined in the same manner as in Step 600, and then it is determined whether or not the position of the carriage 31 has reached the position P2.

That is, a position P2*a* (the position of the carriage 31 when the speed of the carriage 31 reaches SPD2) is calculated by the motion sensor processing circuit 77 by using the image signal 70*a* from the motion sensor 70, and a position shifted from the position P2*a* by the accumulated value of the deviation amount of the paper P is determined as the position P2. Then, it is determined whether or not the carriage 31 has reached the position P2.

If YES, a P2 position interrupt signal is sent from the motion sensor processing circuit 77 to the head drive control circuit 56 through the signal line 102, and the process proceeds to Step 630. If the position of the carriage 31 has not reached the position P1, the process returns to Step 620.

In Step 630, Waveform 2 for head driving is read from the group of waveform registers 56*a* of the head drive control circuit 56, and then Waveform 2 is output to the head driver 59 by the head drive waveform generating circuit 56*a*. Accordingly, the printing operation is performed by the print heads 36*a-d* driven by Waveform 2 in Section B shown in FIG. 6A. Waveform 2, which is read in Step 540 depending on the type of the paper identified in Step 140 as described above, is one of Waveform 2*a*, Waveform 2*b* and Waveform 2*c*.

In Step 640, the position P3 is determined in the same manner as in Step 600, and then it is determined whether or not the carriage 31 has reached the position P2.

That is, a position P3*a* (the position of the carriage 31 when the speed of the carriage 31 reaches SPD3) is calculated by the motion sensor processing circuit 77 by using the image signal 70*a* from the motion sensor 70, and a position shifted from the position P2*a* by the accumulated value of the deviation amount of the paper P is determined as the position P3. Then, it is determined whether or not the carriage 31 has reached the position P3.

If YES, a P3 position interrupt signal is sent from the motion sensor processing circuit 77 to the head drive control circuit 56 through the signal line 102, and the process proceeds to Step 650. If the carriage 31 has not reached the position P3, the process returns to Step 640.

In Step 650, Waveform 3 for head driving is read from the group of waveform registers 56*a* of the head drive control circuit 56, and then Waveform 3 is output to the head driver 59 by the head drive waveform generating circuit 56*c*. Accordingly, the printing operation is performed by the print heads 36*a-d* driven by Waveform 3 in Section C shown in FIG. 6A. Waveform 3, which is read in Step 540 depending on the type of the paper identified in Step 140 as described above, is one of Waveform 3*a*, Waveform 3*b* and Waveform 3*c*.

In Step 660, the position P4 is determined in the same manner as in Step 600, and then it is determined whether or not the carriage 31 has reached the position P4.

That is, a position P4*a* (the position of the carriage 31 when the speed of the carriage 31 falls below SPD3) is calculated by the motion sensor processing circuit 77 by using the image signal 70*a* from the motion sensor 70, and a position shifted from the position P4*a* by the accumulated value of the deviation amount of the paper P is determined as the position P4. Then, it is determined whether or not the carriage 31 has reached the position P4.

If YES, a P4 position interrupt signal is sent from the motion sensor processing circuit 77 to the head drive control circuit 56 through the signal line 102, and the process proceeds to Step 670. If the carriage 81 has not reached the position P4, the process returns to Step 660.

In Step 670, Waveform 2 for head driving is read from the group of waveform registers 56*a* of the head drive control circuit 56, and then Waveform 2 is output to the head driver 59 by the head drive waveform generating circuit 56*c*. Accordingly, the printing operation is performed by the print heads 36*a-d* driven by Waveform 2 in Section D shown in FIG. 6A.

In Step 680, the position P5 is determined in the same manner as in Step 600, and then it is determined whether or not the carriage 31 has reached the position P5.

That is, a position P5*a* (the position of the carriage 31 when the speed of the carriage 31 falls below SPD2) is calculated by the motion sensor processing circuit 77 by using the image signal 70*a* from the motion sensor 70, and a position shifted from the position P5*a* by the accumulated value of the deviation amount of the paper P is determined as the position P5. Then, it is determined whether or not the carriage 31 has reached the position P5.

If YES, a P5 position interrupt signal is sent from the motion sensor processing circuit 77 to the head drive control circuit 56 through the signal line 102, and the process proceeds to Step 690. If it is determined that the carriage 31 has not reached the position P5, the process returns to Step 680.

In Step 690, Waveform 1 for head driving is read from the group of waveform registers 56*a* of the head drive control circuit 5, and then Waveform 1 is output to the head driver 59 by the head drive waveform generating circuit 56*c*.

Accordingly, the printing operation is performed by the print heads 36*a-d* driven by Waveform 1 in Section E shown in FIG. 6A.

When it is determined that the carriage 31 has reached a position P6 determined in the same manner as the above P1 to P5, the head drive control circuit 56 stops outputting the waveform of the printing signal to the head driver 59 to end the printing, and thereby the printing operation of a single line is terminated.

Returning to the main routine in FIG. 9, it is determined in Step 270 whether or not any printing data that has not been printed yet is present. If YES, the process proceeds to Step 160, while if NO, the process proceeds to Step 280.

In Step 280, the feed motor 62 is driven by a specified amount for discharging the paper P toward the downstream side of the feed path 4.

In contrast, if it is determined NO in Step 190 (in the case where it is determined that the paper edge detection sensor 42 is off), a trailing end printing process is executed.

Figure 19:
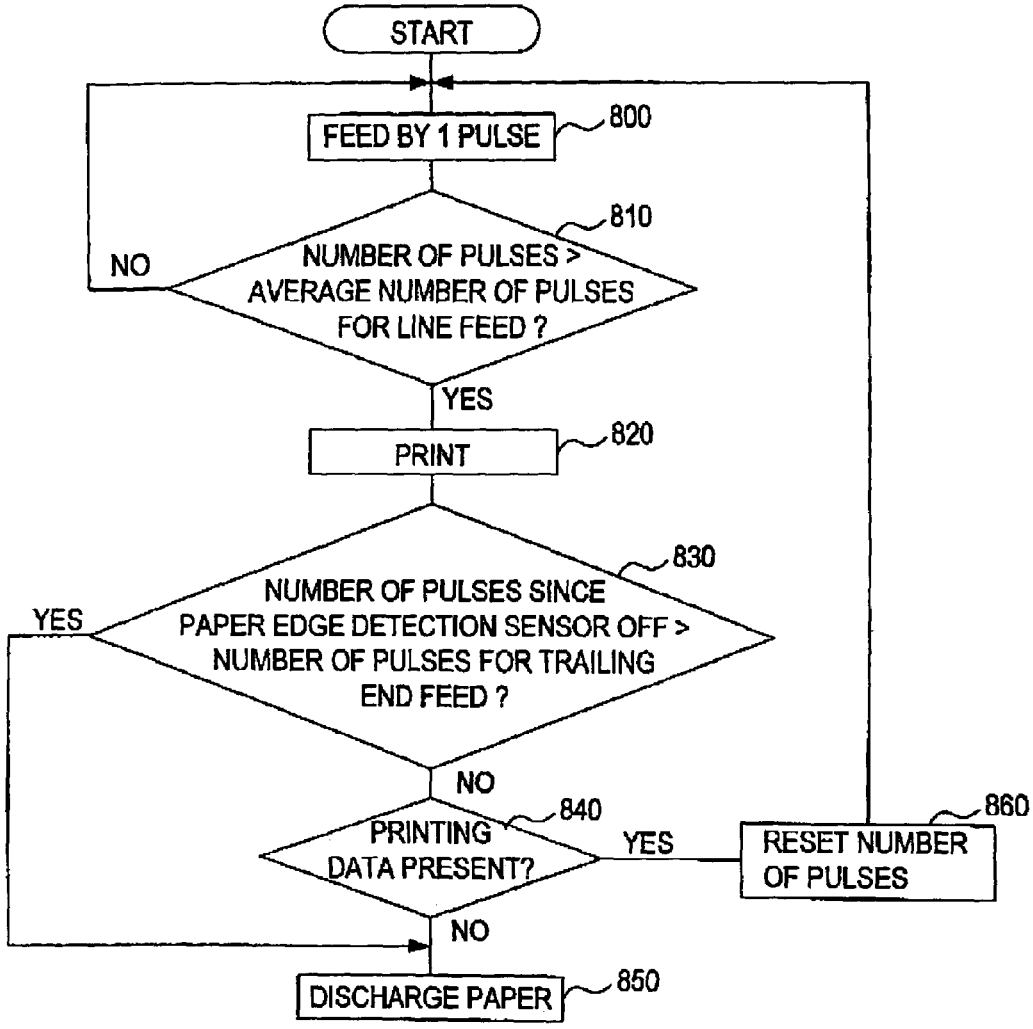
FIG. 19 is an explanatory view showing a trailing end printing process performed by the ink jet printer 1 of Embodiment 1.

The trailing end printing process will now be described by using FIG. 19.

In Step 800, the paper P is fed in the downstream direction by driving the feed motor 62 by a single pulse.

In Step 810, it is determined whether or not the number of pulses has reached the average number of pulses for line feed set in Step 260. If it is determined YES, the process proceeds to Step 820, while if it is determined NO, the process proceeds to Step 800.

In Step 820, printing corresponding to a single line is performed as in Step 260. It is the head portion of the printing data which have not been printed yet that is to be printed in this Step 820.

In Step 830, it is determined whether or not the number of times Step 800 has been executed since the motion sensor 70 detected the trailing end of the paper P (since it was determined NO in Step 190) has reached a specified number of pulses for trailing end feeding (that is, whether or not printing has been completed up to the trailing end of the paper P). If NO, the process proceeds to Step 840, while, if YES, the process proceeds to Step 850.

In Step 840, it is determined whether or not any printing data that has not been printed yet is present. If NO, the process proceeds to Step 850, while, if YES, the process proceeds to Step 860.

In Step 850, the first feed roller 21 and the second feed roller 25 are driven by the feed motor 62 to discharge the paper P toward the downstream side of the feed path 4.

In contrast, if it is determined YES in Step 840, the process proceeds to Step 860. In Step 860, the number of pulses stored in the RAM 53 is reset, and the process proceeds to Step 800.

With the above arrangement, after the trailing end of the paper P passes the paper edge detection sensor 42, feeding of the paper P is controlled on the basis of the average number of pulses for line feed before then, 80 that feeding of the paper P can be performed appropriately even if the trailing end of the paper P should pass through the motion sensor 70 after then. Accordingly, it is possible to perform so-called margin-less printing, i.e. printing almost up to the trailing end of the paper P.

It is to be understood, however, that after the trailing end of the paper P passes through the motion sensor 70, the moving position of the carriage 31 cannot be detected by the motion sensor 70, and, therefore, it is necessary to detect the position and speed of the carriage by usual means such as an encoder.

However, when the surface of the paper guide portion 2*b* (the platen) facing the motion sensor 70 is configured so as to generate a speckle pattern, the image signal 70*a* (generated based on the reflected light from the paper guide portion 2*b*) from the motion sensor 70 can be used as it is (to detect the position and speed of the carriage).

g) Effects provided by the ink jet printer 1 will now be described.

① In the ink jet printer 1 of the present embodiment, the position of the carriage 31 in the main scanning direction is detected by using the motion sensor 70, and the reciprocation of and the printing by the carriage 31 are controlled based on the detected position. Accordingly, a high accuracy in the timing of the reciprocation and the printing of the carriage 31 is achieved, which allows accurate printing.

② In the ink jet printer 1 of the present embodiment, the paper feed amount is detected by using the motion sensor 70, and the feeding of the paper is controlled based on the feed amount. Accordingly, a high accuracy in the paper feed is achieved, which allows accurate printing.

③ In the ink jet printer 1 of the present embodiment, the deviation of the paper is detected by using the motion sensor 70, and the printing area of the carriage 31 is changed based on the deviation amount. That is, the position P1 which is a position where the carriage 31 starts printing and the position P6 which is a position where the carriage 31 completes printing are set in accordance with the deviation amount of the paper P.

Accordingly, even when the paper is fed with deviation, it is possible to prevent deviation of the printing area of the paper or ejection of ink to the outside of the paper, which may result in stains on the ink jet printer 1.

④ In the ink jet printer 1 of the present embodiment, the type of the paper is identified by using the motion sensor 70, and the printing conditions may be changed in accordance with the type of the paper. In other words, the head drive waveform is selected in accordance with the type of the paper. This allows printing to be performed always under the conditions corresponding to the type of the paper.

⑤ According to the ink jet printer 1 of the present embodiment, the paper P is fed at a high speed through normal motor control during a period of time from when the paper P is taken out from the paper feed cassette 11 until the head of the printing area of the paper P reaches right under the print head 36, and after completion of printing (i.e. after completion of printing corresponding to the printing data or after performing printing to the last of the printing area of the paper P).

During printing, feeding of the paper P is controlled in a highly accurate manner on the basis of the image signal 70*a* received from the motion sensor 70.

In other words, during the printing process in which highly accurate paper feed is required, feeding is performed by using the motion sensor, and during a period in which accuracy of paper feed is not so much required (prior to the start of printing and after the completion of printing), the paper P is fed at a high speed through normal motor control to thereby achieve both highly accurate printing and reduced printing time.

⑥ According to the ink jet printer 1 of the present embodiment, the paths of laser light within the motion sensor 70 (the semiconductor laser 74, points on the paper at which laser light is reflected and the two-dimensional semiconductor image sensor 76) are all housed inside of the housing 73.

This prevents leakage of laser light to the exterior of the housing 73 and results in smaller effects of laser light on human bodies.

⑦ According to the ink jet printer 1 of the present embodiment, the laser light within the motion sensor 70 is irradiated downward.

Accordingly, if it should happen that the direction of the semiconductor laser is deviated to cause leakage of laser light to the exterior of the motion sensor, possible effects on human bodies can be reduced.

⑧ It is the two-dimensional semiconductor image sensor 76 having two-dimensionally arranged pixels that receives the reflected light within the motion sensor 70 of the ink jet printer 1 of the present embodiment.

Since speckle patterns generated by the reflected light may thus be detected as two-dimensional images, it is possible to perform accurate comparison of speckle patterns by the motion sensor processing circuit 77. Accordingly, control of the reciprocation of and the printing by the carriage 31, feed control of the paper P, identification of the type of paper and detection of the deviation amount can be performed in a further accurate manner.

It is to be understood that the present invention is not limited to the above described embodiment, but may be practiced in various forms within the scope not departing from the gist of the present invention.

Figure 10:
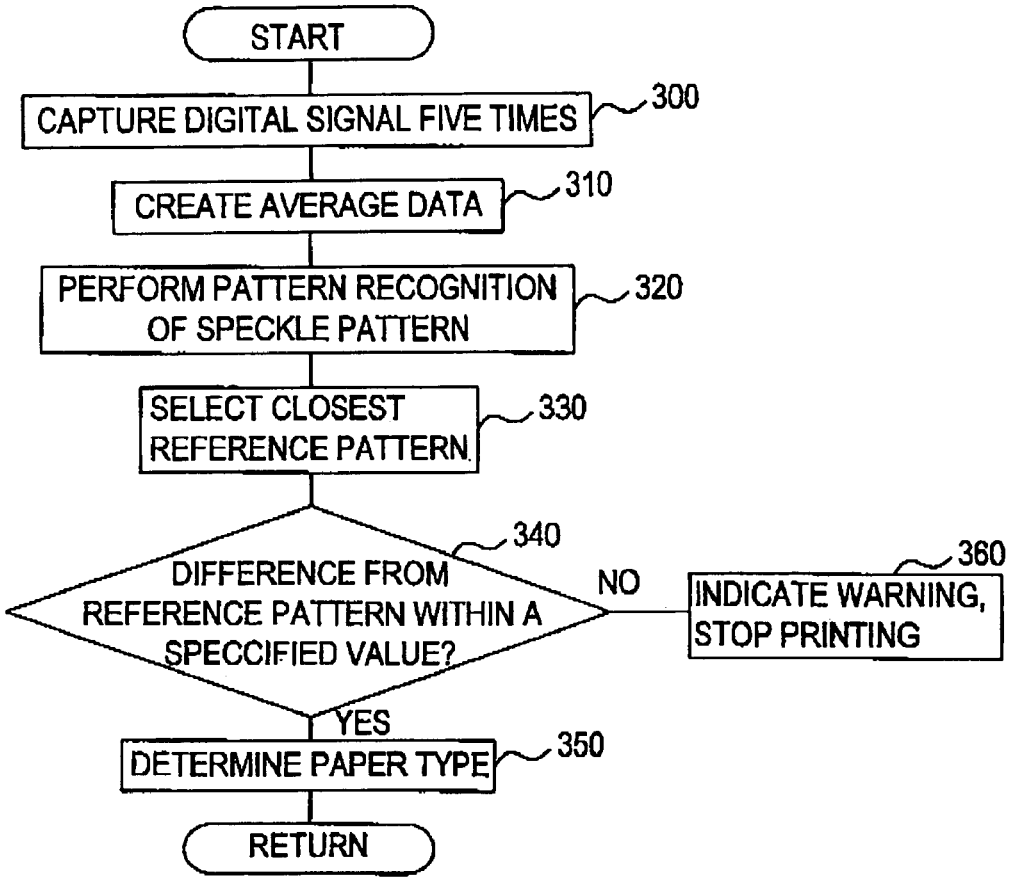
FIG. 10 is an explanatory view showing a paper type determination process performed by the ink jet printer 1 of Embodiment 1.

For example, the type of paper can be determined based on the light intensity of the average data in the paper type determination process (FIG. 10).

Specifically, the light intensity of the average data is measured in Step 320, and a reference light intensity (previously stored in ROM 52 depending, respectively, on the types of paper) closest to the measured light intensity is selected in Step 330. Then, it is determined in Step 350 that the type of the paper P is a paper corresponding to the reference light intensity selected in Step 330.

INDUSTRIAL APPLICABILITY

According to an image forming apparatus of the present invention, as described above in detail, it is possible to control reciprocation of a carriage and paper feed in a highly accurate manner and to form an image of high quality even when paper moves in a deviated direction or paper of a different type from that of the paper prescribed at the printer is supplied.

The invention claimed is:

1. An image forming apparatus having a recording device provided to be reciprocable in a width direction of paper that performs recording on the paper, the image forming apparatus comprising:

a paper position signal generating device that irradiates the paper with a light with coherence and receives a reflected light of the light with coherence to generate a paper position signal with respect to a position of the paper, wherein the paper position signal generating device is provided so as to move in synchronization with the recording device in the width direction; and a recording device moving amount detection device that detects a recording device moving amount that is a moving amount of the recording device in the width direction by using the paper position signal, wherein the recording device moving amount detection device detects the moving amount of the recording device with respect to the paper by chronologically comparing speckle patterns generated by the light being reflected from the paper.

2. The image forming apparatus as set forth in claim 1, wherein the paper position signal generating device is mounted to a carriage that holds the recording device.

3. The image forming apparatus as set forth in claim 1, wherein recording on the paper by the recording device in the width direction is controlled by using the recording device moving amount.

4. The image forming apparatus as set forth in claim 1, further comprising:

a paper feed device that feeds the paper; and a paper feed amount detection device that detects a paper feed amount by using the paper position signal.

5. The image forming apparatus as set forth in claim 4, wherein the feed device is controlled by using the paper feed amount detection device.

6. The image forming apparatus as set forth in claim 4, wherein the paper feed amount detection device calculates the paper feed amount by chronologically comparing the speckle patterns generated by the light being reflected from the paper.

7. The image forming apparatus as set forth in claim 4, further comprising a deviation detection device that detects deviation when the paper is fed by using the paper position signal.

8. The image forming apparatus as set forth in claim 7, wherein a movement of the recording device is controlled based on a deviation amount detected by the deviation detection device.

9. The image forming apparatus as set forth in claim 8, wherein a movement of the recording device is controlled such that a position at which recording on the paper is performed is a predetermined position.

10. The image forming apparatus as set forth in claim 4, wherein the feeding of the paper is prohibited while the recording device is moved in the width direction, and wherein the movement of the recording device in the width direction is prohibited while the paper is fed.

11. The image forming apparatus as set forth in claim 1, further comprising a paper condition identification device that identifies conditions of the paper by using the paper position signal.

12. The image forming apparatus as set forth in claim 11, wherein the paper condition identification device identifies a type of the paper based on the speckle patterns generated by the light being reflected from the paper.

13. The image forming apparatus as set forth in claim 11, wherein the recording device changes recording conditions depending on conditions of the paper identified by the paper condition identification device.

14. The image forming apparatus as set forth in claim 1, wherein receipt of the light is performed by using a photoreceptor including a plurality of two-dimensionally arranged pixels.

15. The image forming apparatus as set forth in claim 1, wherein a position at which the light is reflected on the paper is upstream with respect to a paper feed direction from a position at which the recording device performs recording.

* * * * *